US006977574B1

(12) United States Patent
Sugiura et al.

(10) Patent No.: US 6,977,574 B1
(45) Date of Patent: Dec. 20, 2005

(54) STICK-TYPE IGNITION COIL HAVING IMPROVED STRUCTURE AGAINST CRACK OR DIELECTRIC DISCHARGE

(75) Inventors: Akimitsu Sugiura, Takahama (JP); Yoshitaka Sato, Toyohashi (JP)

(73) Assignee: Denso Corporation, (JP)

( * ) Notice: Subject to any disclaimer, the term of this patent is extended or adjusted under 35 U.S.C. 154(b) by 67 days.

(21) Appl. No.: 09/635,138

(22) Filed: Aug. 9, 2000

Related U.S. Application Data

(62) Division of application No. 09/023,613, filed on Feb. 13, 1998, now Pat. No. 6,208,231.

(30) Foreign Application Priority Data

| | | |
|---|---|---|
| Feb. 14, 1997 | (JP) | 9-30403 |
| Feb. 14, 1997 | (JP) | 9-30404 |
| Apr. 28, 1997 | (JP) | 9-110836 |
| Jun. 30, 1997 | (JP) | 9-173947 |
| Aug. 7, 1997 | (JP) | 9-213626 |
| Aug. 8, 1997 | (JP) | 9-214939 |
| Aug. 8, 1997 | (JP) | 9-214940 |
| Aug. 8, 1997 | (JP) | 9-214941 |
| Aug. 8, 1997 | (JP) | 9-214943 |
| Dec. 25, 1997 | (JP) | 9-357011 |
| Dec. 25, 1997 | (JP) | 9-357143 |

(51) Int. Cl.[7] ..... H01F 27/24
(52) U.S. Cl. ..... 336/219; 336/90; 336/198
(58) Field of Search ..... 336/65, 90–96, 336/107, 192, 220–222; 123/634–635

(56) References Cited

U.S. PATENT DOCUMENTS

| | | | | |
|---|---|---|---|---|
| 2,743,308 A | | 4/1956 | Bardsley | |
| 4,325,096 A | | 4/1982 | Sunohara | |
| 4,514,712 A | | 4/1985 | McDougal | |
| 4,532,398 A | | 7/1985 | Henriksson | |
| 4,736,179 A | | 4/1988 | Behnke | |
| 4,744,337 A | * | 5/1988 | Ebinuma et al. | 123/41.66 |
| 4,803,454 A | | 2/1989 | Umezaki | |
| 4,982,498 A | | 1/1991 | Umezaki | |
| 5,416,459 A | | 5/1995 | Ida et al. | |
| 5,703,556 A | | 12/1997 | Kikuta | |
| 5,767,758 A | * | 6/1998 | Sakamaki | 336/84 M |
| 5,778,863 A | | 7/1998 | Oosuka | |
| 5,870,012 A | * | 2/1999 | Sakamaki et al. | 336/107 |

FOREIGN PATENT DOCUMENTS

| | | |
|---|---|---|
| CA | 1 156 732 | 11/1983 |
| DE | 2512714 | 9/1976 |
| DE | 3113743 A1 | 10/1982 |

(Continued)

OTHER PUBLICATIONS

Journal of NIPPONDENSO Technical Disclosure; *Ignition Device for Internal Combustion Engine;* No. 81-083; Nov. 15, 1991 with Translation.

(Continued)

*Primary Examiner*—Tuyen T Nguyen
(74) *Attorney, Agent, or Firm*—Nixon & Vanderhye PC

(57) ABSTRACT

A stick-type ignition coil have a central core, a cylindrical member, primary spool, primary coil, secondary spool, secondary coil, outer core and a resin insulator. The two longitudinal end corners and faces of the core are covered by respective buffer members. The inner circumferential corners of the outer core is supported by ring members. Some of the members disposed radially inside and other members disposed radially outside of the inside members are held slidably to each other in the ignition coil. The spools are made of resin containing a rubber in excess of 5 weight percent and reinforcing materials. The resin insulator contains a flexible material.

14 Claims, 21 Drawing Sheets

FOREIGN PATENT DOCUMENTS

| | | | |
|---|---|---|---|
| EP | 0258036 | | 3/1988 |
| EP | 0388146 | A1 | 9/1990 |
| EP | 0738831 | A2 | 10/1996 |
| EP | 0 782 231 | A1 | 2/1997 |
| EP | 0827163 | A2 | 3/1998 |
| GB | 2302616 | A | 1/1997 |
| JP | A 50-74123 | | 6/1975 |
| JP | 52-017136 | | 2/1977 |
| JP | 58-61615 | | 4/1983 |
| JP | Y2 59-030501 | | 8/1984 |
| JP | 60-103608 | | 6/1985 |
| JP | 61-158116 | | 7/1986 |
| JP | A 62-166745 | | 7/1987 |
| JP | 62-172127 | | 10/1987 |
| JP | 62 197831 | | 12/1987 |
| JP | 63-105317 | | 7/1988 |
| JP | A-63-293908 | | 11/1988 |
| JP | 64-001445 | | 1/1989 |
| JP | 1 63120 | | 4/1989 |
| JP | 1 125519 | | 8/1989 |
| JP | 2-92912 | | 7/1990 |
| JP | 2 301105 | | 12/1990 |
| JP | A-3-208313 | | 9/1991 |
| JP | 3 236208 | | 10/1991 |
| JP | 04-144217 | | 5/1992 |
| JP | 4-144218 | * | 5/1992 |
| JP | 05-012922 | | 1/1993 |
| JP | A 05-021242 | | 1/1993 |
| JP | A 05-146107 | | 6/1993 |
| JP | A-5-220767 | | 8/1993 |
| JP | 5 267072 | | 10/1993 |
| JP | 07-142233 | | 6/1995 |
| JP | 08-102424 | | 4/1996 |
| JP | 08-124779 | | 5/1996 |
| JP | 3026649 | | 5/1996 |
| JP | 08-203757 | | 8/1996 |
| JP | A 09-022825 | | 1/1997 |
| JP | 9-115749 | | 5/1997 |
| JP | A 9-167709 | | 6/1997 |
| JP | A 09-171934 | | 6/1997 |
| JP | 9 186034 | | 7/1997 |
| JP | 3028977 | | 7/1997 |
| JP | 10-22144 | | 2/1998 |
| JP | 10-112413 | | 4/1998 |
| JP | A 09-180948 | | 7/1999 |
| WO | WO 93/13533 | | 8/1993 |

OTHER PUBLICATIONS

Patent Abstracts of Japan, vol. 007, No. 233 (E-204), Oct. 15, 1983 & JP 58 122713A (Hanshin Electric KK), Jul. 21, 1983.

Patent Abstracts of Japan, vol. 096, No. 005, May 31, 1996 & JP 08 017657 A (Nippondense Co. Ltd.), Jan. 19, 1996.

Patent Abstracts of Japan, vol. 010, No. 035 (E-380), Feb. 12, 1986 & JP 60 192313 A (Nippon Denso KK), Sep. 30, 1985.

Patent Abstracts of Japan, vol. 013, No. 254 (E-772), Jun. 13, 1989 & JP 01 053514A (Nippon Denso Co. Ltd.), Mar. 1, 1989.

Patent Abstracts of Japan, vol. 096, No. 008, Aug. 30, 1996 & JP 08 086267A (Toyo Denso Co. Ltd.), Apr. 2, 1996.

Patent Abstracts of Japan, vol. 097, No. 005, May 30, 1997 & JP 09 017662A (Hitachi Ltd: Hitachi Automot Eng Co Ltd), Jan. 17, 1997.

Patent Abstracts of Japan, vol. 018, No. 430 (C-1236), Aug. 11, 1994 & JP 06 128471A (Toray Ind Inc); May 10, 1994.

Patent Abstracts of Japan, vol. 096, No. 003,Mar. 29, 1996 & JP 07 312839 A (Mitsubishi Electric Corp): Nov. 28, 1995.

Engineering Drawing No. 029700-4790 of DENSO dated 1990.

* cited by examiner

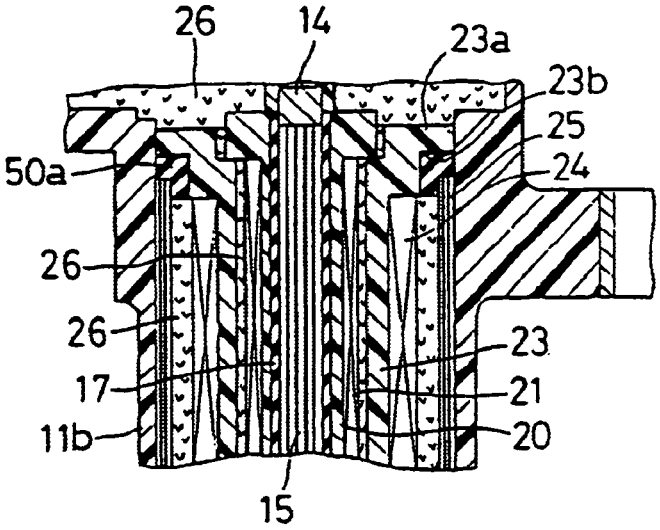
FIG. 11
FIG. 12
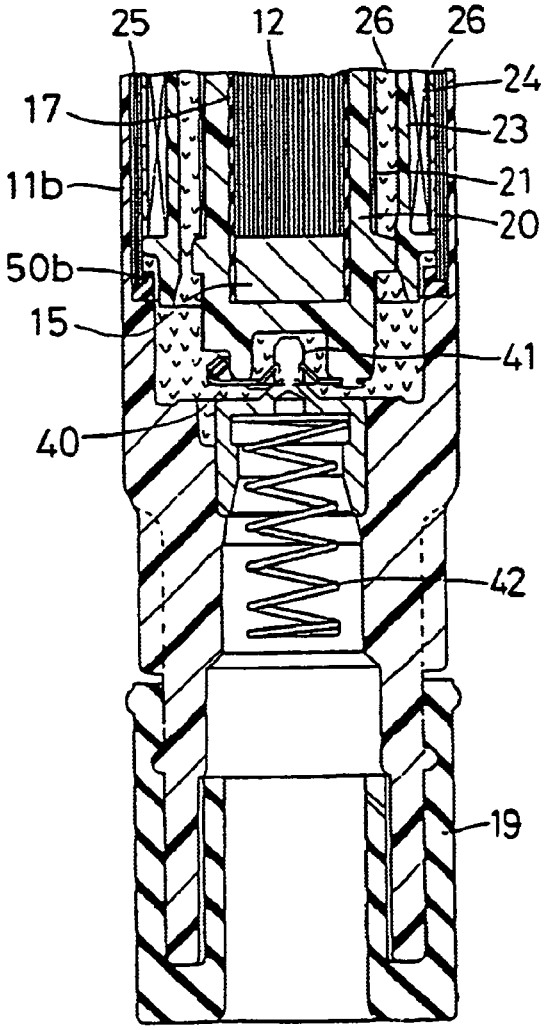

STICK-TYPE IGNITION COIL HAVING IMPROVED STRUCTURE AGAINST CRACK OR DIELECTRIC DISCHARGE

This application is a division of Ser. No. 09/023,613, filed Feb. 13, 1998 now U.S. Pat. No. 6,208,231.

CROSS REFERENCE TO RELATED APPLICATION

This application relates to and incorporates herein by reference Japanese Patent Application Nos. 9-30403, 9-30404, 9-110836, 9-173947, 9-213626, 9-214939, 9-214940, 9-214941, 9-214943, 9-357011 and 9-357143, filed on Feb. 14, 1997, Feb. 14, 1997, Apr. 28, 1997, Jun. 30, 1997, Aug. 7, 1997, Aug. 8, 1997, Aug. 8, 1997, Aug. 8, 1997, Aug. 8, 1997, Dec. 25, 1997 and Dec. 25, 1997, respectively.

BACKGROUND OF THE INVENTION

1. Field of the Invention

The present invention relates to an ignition coil for an internal combustion engine and, more particularly, to a stick-type ignition coil to be fitted directly in the plug hole of an internal combustion engine.

2. Description of Related Art

As an ignition coil, a stick-type ignition coil is known. It has a rod-shaped central core disposed in a housing, and a primary coil and a secondary coil wound respectively on a primary spool and a secondary spool made of resin. Resin is filled in the housing of the ignition coil as an electric insulator. The insulator not only provides electric insulation among individual members in the housing but also fills clearances between wires of the coils thereby to restrict movement or breakage of the coils which may arise from engine vibrations. As the insulator, a thermosetting resin such as epoxy is used in consideration of the heat resistance. The ignition coil further has a permanent coil 22 magnet attached to at least one of the two longitudinal ends of the central core to raise a voltage to be supplied to a spark ignition plug.

In this type of ignition coil, the central core contacts with not only the resin insulator but also a case member such as a spool enclosing the outer circumference of the central core. The central core and the resin insulator or the case member, as having different thermal expansion coefficients, may repeatedly expand and contract as the surrounding temperature rises and falls. Then, the resin insulator or the case member, as contacting with the central core, especially the resin insulator or the case member contacting the longitudinal end corners of the central core, may crack, which results in defective electric insulation.

When the resin insulator or the case member around the central core cracks, an electric discharge may occur through the cracks between the secondary coil or a high voltage terminal (high voltage side) and the central core (low voltage side). If the discharge occurs between the high voltage side and the central core, the electric insulation between the high voltage side and the central core is broken to lower the voltage to be generated in the secondary coil, thus disabling a generation of desired high voltage.

If the central core and the resin insulator or the case member repeatedly expand and the contract due to changes the temperature, the central core is caused to receive a load in the radial direction and in the longitudinal direction from the resin insulator and the case member due to the difference in the thermal expansion coefficient. Especially when the central core receives the load in the longitudinal direction, the magnetic permeability of the core may drop causing magneto-striction which disables generation of a required high voltage.

It is desired in a stick-type ignition coil to dispose an outer core around the outer periphery of the primary spool and the secondary spool. Since this outer core contacts directly with the insulator in the housing, the outer core and the insulator having different thermal expansion coefficients, may repeat expansions and contractions as the temperature changes. As a result, the insulator contacting with the outer core may crack causing an electric discharge between the secondary coil or a high voltage terminal the outer core. This discharge lowers the high voltage to be applied to the ignition plug.

In another ignition coil disclosed in Japanese Utility Model Publication No. 59-30501, although not a stick-type, the corners of the core are covered by over-coating the surface of the core with an elastomer. This prevents the corners of the core and the insulator made of epoxy resin from coming into direct contact with each other and suppresses cracks in the epoxy resin in the vicinity of the corners of the core. This over coating is not applicable to the stick-type ignition coil because the stick-type is so regulated in its external diameter as to match the internal diameter of the plug hole.

SUMMARY OF THE INVENTION

It is an object of the present invention to provide an ignition coil capable of suppressing drawbacks caused by changes in surrounding temperature.

It is another object of the invention to provide an ignition coil capable of suppressing cracks from occurring in the vicinity of the longitudinal end corners of the a central core and/or outer core.

It is a further object of the invention to provide an ignition coil capable of suppressing dielectric breakdown caused by changes in surrounding temperature.

According to the first aspect of the invention, an ignition coil has an elastic buffer member at at least one of longitudinal end corners of a central core to absorb a difference in thermal expansion coefficients between the central core and a resin insulator or a case member such as a spool. As a result, even if the resin insulator or the case member having the thermal expansion coefficient different from that of the central core repeatedly expands and contracts together with the central core as the temperature changes, the resin insulator and the case member in the vicinity of the longitudinal end corners of the central core can be prevented from cracking. Alternatively, at least one of the two end corners of the central core may be surrounded by a space, so that a case member such as a spool or a resin insulator enclosing the outer circumference of the central core is not in contact with the longitudinal end corners of the central core.

According to the second aspect of the invention, an ignition coil has an angled member to cover the inner circumference corner of the longitudinal end of an outer core which is arranged around the outer circumferences of a primary coil and a secondary coil, so that a resin insulator is restricted from coming into direct contact with the inner circumference corner of the outer core. As a result, even if the outer core and the resin insulator having different expansion coefficients, repeatedly expands and contracts as the temperature changes, cracks can be suppressed in the resin insulator in the vicinity of the inner circumference corner of the outer core. As a result, the electric discharge can be suppressed so that the drop in the voltage to be applied to an ignition plug can be restricted. Alternatively, the spool may have a flange to be arranged to cover the longitudinal end corner of the outer core, so that the cracks, if caused in the resin insulator in the vicinity of the inner circumference corner of the outer core, will hardly extend to the inner circumference because of being shielded by the outer spool. As a result, the cracks are less likely to reach electric wires connecting the coils and terminals in the ignition coil electrically.

According to the third aspect of the invention, an ignition coil has a separating member to separate a spool and a resin insulator from each other so that the spool and the resin insulator disposed inside and outside of the separating member can expand/contract separately from each other with a change in temperature. Thus, the spool and the resin insulator are prevented from cracking in a peripheral part on which a large force is liable to act.

According to the fourth aspect of the invention, a resin material used for at least an inner one of a primary spool and a secondary spool contains more than 5 weight % of rubber component. Accordingly, even if the inner spool is hindered from contracting toward the inside more than a coil wound thereon in low temperature by adhesion, it can reduce the distortion and can extend while maintaining the adhesion with the coil, thereby restricting the inner spool from cracking.

According to the fifth aspect of the invention, an ignition coil has an insulator made of a flexible material to hold individual members adhered to one another even if the members having different thermal expansion coefficients expand and contract as the temperature changes. Preferably, an average of the thermal expansion coefficient at −40° C. to 130° C. is set within a range of 10 to 30 ppm in a test method corresponding to ASTMD790, so that a thermal expansion coefficient of the insulator becomes close to that of iron or copper used for a core or coils, thus restricting distortion of spools and the insulator.

BRIEF DESCRIPTION OF THE DRAWINGS

Other objects, features and advantages of the present invention will become more apparent from the following detailed description with reference to the embodiments shown in the accompanying drawings. In the drawings:

FIG. 11 is an enlarged sectional view showing a low voltage side of the ignition coil according to the fifth embodiment;

FIG. 12 is a sectional view showing a high voltage side of the ignition coil according to the fifth embodiment;

DETAILED DESCRIPTION OF THE PREFERRED EMBODIMENT

Figure 1:
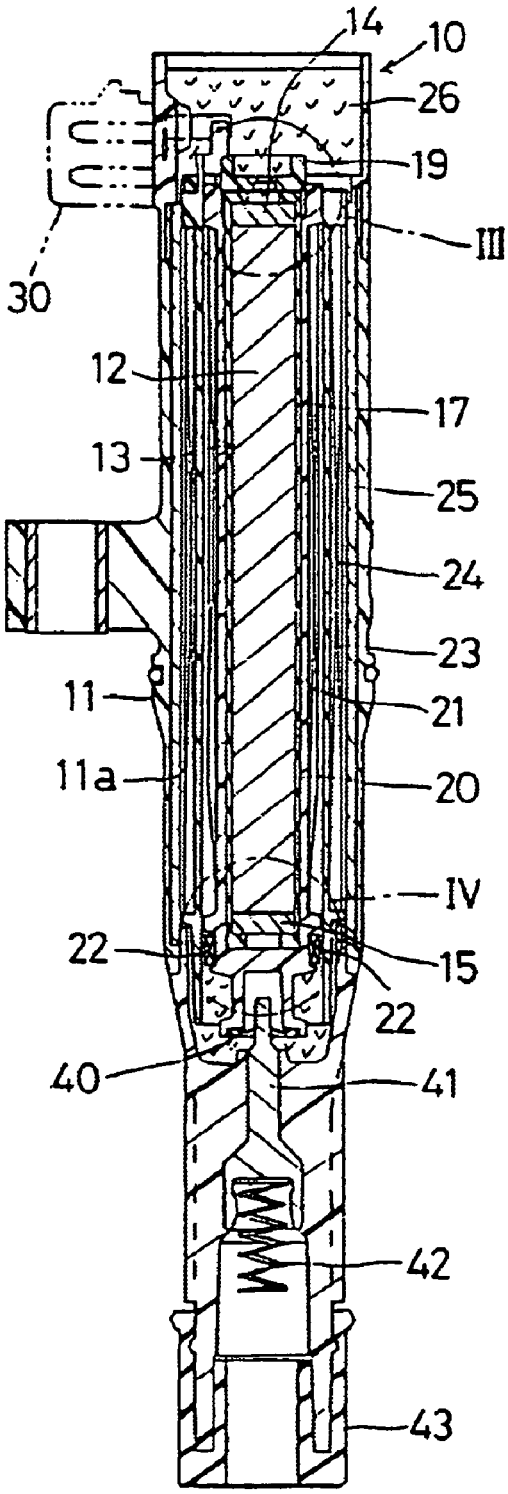
FIG. 1 is a longitudinal sectional view showing an ignition coil according to the first embodiment of the invention.

The present invention will be described with reference to various embodiments throughout which the same or like parts are designated by the same or similar reference numerals.

First Embodiment

An ignition coil 10 is fitted, as shown in FIG. 1, in a plug hole (not shown) which is formed in each cylinder head of an internal combustion engine, and is electrically connectable to a spark ignition plug.

The ignition coil 10 has a cylindrical housing 11 made of a resin, in which an accommodating chamber 11*a* is formed to accommodate a central core assembly 13, a secondary spool 20, a secondary coil 21, a primary spool 23, a primary coil 24 and an outer core 25. The central core assembly 13 is comprised of a core 12, and permanent magnets 14 and 15 arranged at the two longitudinal ends (top and bottom) of the core 12. An epoxy resin 26 filled in the accommodating chamber 11*a* infiltrates between the individual members of the ignition coil 10 to ensure the electric insulations among the members as a resin insulating material.

The core 12 having a column shape is provided by laminating a thin silicon (Si) steel sheet radially to have a generally circular transverse section. The permanent magnets 14 and 15 are magnetized to have a magnetic polarity in the direction opposed to the direction of the magnetic flux which is generated by magnetizing the coils. On the other hand, the outer circumference of the core 12 is covered with a cylindrical member 17 made of rubber acting as a first buffer member. On the permanent magnet 14 covered with the cylindrical member 17, moreover, there is fitted a cap 19 having a through hole. The cap 19 and the secondary spool 20 construct a case member enclosing the outer circumference of the central core assembly 13.

Figure 2:
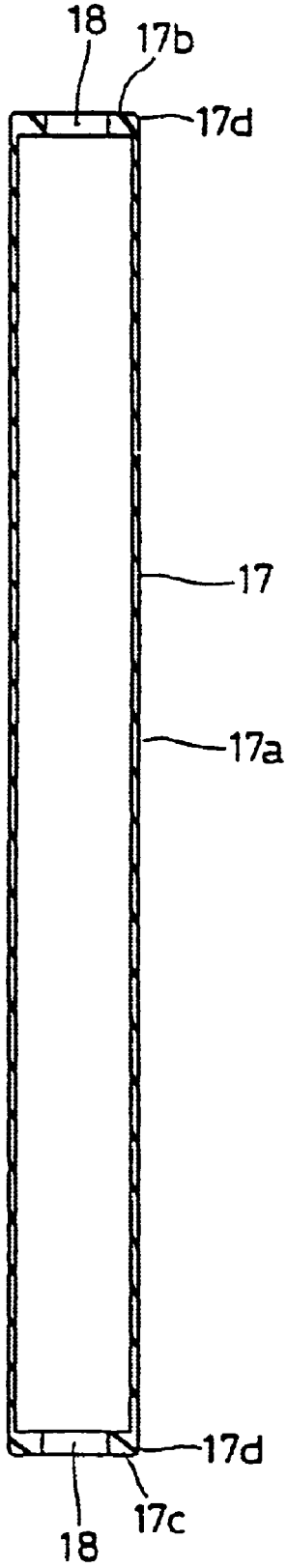
FIG. 2 is a sectional view showing a cylindrical member used in the first embodiment.
Figure 3:
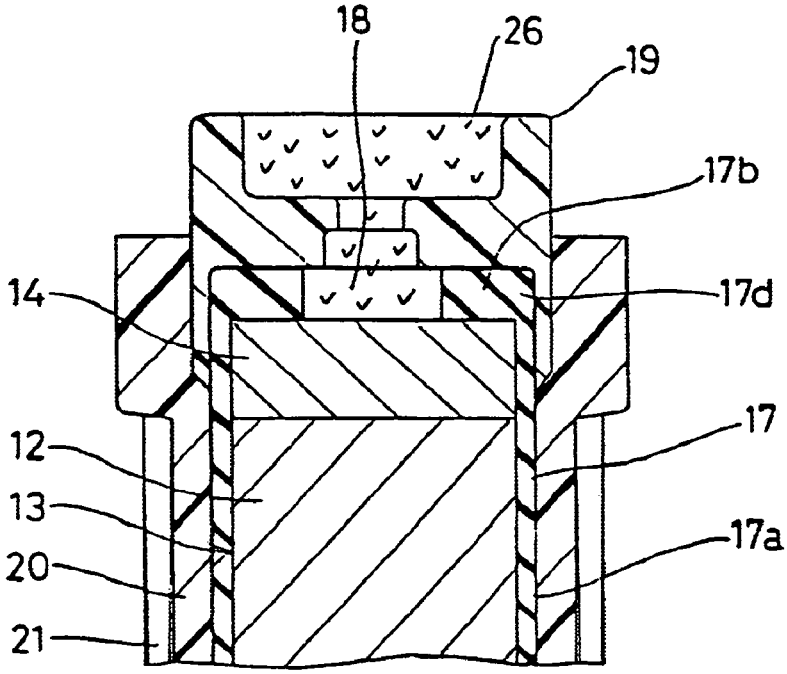
FIG. 3 is an enlarged sectional view showing one end portion of the ignition coil according to the first embodiment, the one portion being designated by a circle III in FIG. 1.
Figure 4:
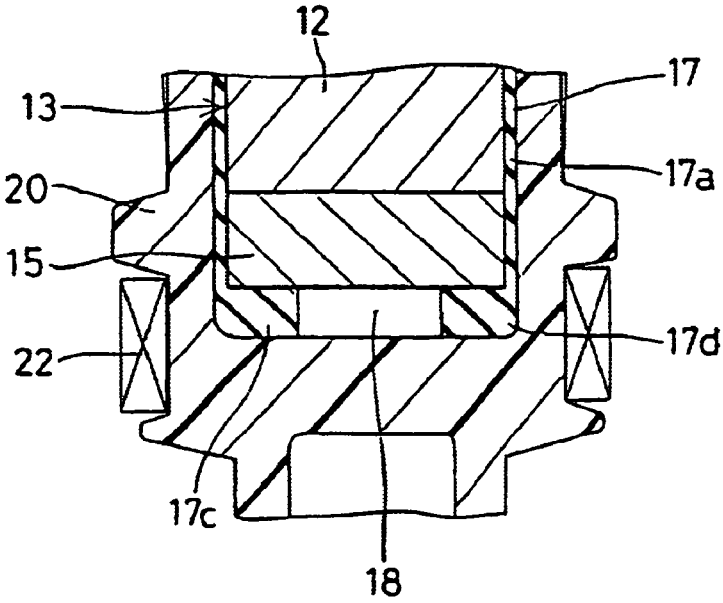
FIG. 4 is an enlarged sectional view showing the other end portion of the ignition coil according to the first embodiment, the other portion being designated by a circle IV in FIG. 1.

The cylindrical member 17 is integrally formed into a cylindrical tube shape, as shown in FIG. 2. The cylindrical member 17 is comprised of a cylindrical part 17*a*, annular or ring end parts 17*b* and 17*c* formed at the two longitudinal ends (top and bottom) of the cylindrical part 17*a* and having through holes 18 formed at their centers, and angled parts 17*d* formed at corners between the cylindrical part 17*a* and the annular end parts 17*b* and 17*c*. As shown in FIGS. 3 and 4, the cylindrical part 17*a* covers the outer circumference of the central core assembly 13, the annular end parts 17*b* and 17*c* cover the portions of the two longitudinal end faces of the central core assembly 13, and the angled parts 17*d* cover the end corners of the permanent magnets 14 and 15 or the two end corners (end edges) of the central core assembly 13. The end parts 17*b* and 17*c* are made thicker than the cylindrical part 17*a* to function as a second buffer member. The through holes 18 are made diametrically smaller than the permanent magnets 14 and 15 so that the core 12 and the permanent magnets 14 and 15 are fitted into the cylindrical member 17 by expanding diametrically the through holes 18.

As shown in FIGS. 1, 3, and 4, the secondary spool 20 is arranged on the outer circumference of the cylindrical member 17 and is molded of a resin material into such a bottomed cylinder as is closed at the longitudinal end side of the permanent magnet 15. The secondary coil 21 is wound on the outer circumference of the secondary spool 20, and a dummy coil 22 is further wound by one turn on the higher voltage side of the secondary coil 21. The dummy coil 22 connects the secondary coil 21 and a terminal plate 40 electrically. Since the secondary coil 21 and the terminal plate 40 are electrically connected through not a single but the dummy coil 22, the surface area of the electrically connected portion between the secondary coil 21 and the terminal plate 40 is enlarged to avoid the concentration of electric field at the electrically connected portion.

The primary spool 23 is arranged on the outer circumference of the secondary coil 21 and is molded of a resin material. The primary coil 24 is wound on the outer circumference of the primary spool 23. A switching circuit (not shown) for supplying a control signal to the primary coil 24 is disposed outside of the ignition coil 10, and the primary coil 24 is electrically connected with the switching circuit through a terminal which is insert-molded on a connector 30.

The outer core 25 is mounted on the outer circumference side of the primary coil 24. The outer core 26 is provided by winding a thin silicon (Si) steel sheet into a cylindrical shape but does not connect the starting end and the terminal end of the winding to leave a gap in the longitudinal direction. The outer core 25 has a longitudinal length from the outer circumference position of the permanent magnet 14 to the outer circumference position of the permanent magnet 15 to form a magnetic circuit.

A high voltage terminal 41 is insert-molded below the housing 11. The central portion of the terminal plate 40 is folded in the direction to insert the high voltage terminal 41 to form a pawl. The high voltage terminal 41 is electrically connected with the terminal plate 40 by inserting the leading end of the high voltage terminal 41 into the pawl. The wire of the dummy coil 22 at the high voltage end is electrically connected with the terminal plate 40 by fusing or soldering. A conductor spring 42 is electrically connected with the high voltage terminal 41 and with the ignition plug when the ignition coil 10 is inserted into the plug hole. In the open end of the housing 11 at the high voltage side, there is mounted a plug cap 43 made of rubber, into which the ignition plug is inserted. When the control signal is fed from the switching circuit to the primary coil 24, a high voltage is generated and is applied to the ignition plug through the dummy coil 22, the terminal plate 40, the high voltage terminal 41 and the spring 42.

In the ignition coil 10, the secondary spool 20 and the epoxy resin 26, as enclosing the central core assembly 13, have a thermal expansion coefficient different from that of the core 12 and the permanent magnets 14 and 15, as constructing the central core assembly 13. Usually, the thermal expansion coefficient of the secondary spool 20 and the epoxy resin 26 is larger than that of the central core assembly 13. As a result, if the central core assembly 13 is not covered with the cylindrical member 17 and if the secondary spool 20 and the epoxy resin 26 are in direct contact with the central core assembly 13, the secondary spool 20 contacting with the central core assembly 13 and the epoxy resin 26 may be cracked by the repeated expansions and contractions of the central core assembly 13, the secondary spool 20 and the epoxy resin 26 according to the temperature change. Especially the secondary spool 20 in contact with the end corners of the permanent magnets 14 and 15 and the epoxy resin 26 are liable to crack. When the secondary spool 20 in contact with the end corners of the permanent magnets 14 and 15 and the epoxy resin 26 crack, an electric discharge may occur through the cracks between the dummy coil 22, the terminal plate 40 or the high voltage terminal 41 at the high voltage side of the secondary coil 21 or the high voltage side and the central core assembly 13 or the low voltage side. If this discharge occurs between the high voltage side and the central core assembly 13, the insulation between the high voltage side and the central core assembly 13 is broken to lower the voltage to be generated at the secondary coil so that the desired high voltage cannot be applied to the ignition plug.

In the first embodiment, however, the outer circumference of the central core assembly 13 and the end corners of the permanent magnets 14 and 15 are covered with the cylindrical member 17 which is an elastic member so that the outer circumference of the central core assembly 13 and the end corners of the permanent magnets 14 and 15 are prevented from coming into direct contact with the secondary spool 20 and the epoxy resin 26. Even if the central core assembly 13 and the secondary spool 20 or the epoxy resin 26 having different thermal expansion coefficients repeat expansions and contractions in accordance with the temperature change, moreover, the cylindrical member 17 can elastically deform to absorb the difference in the thermal expansion coefficients. As a result, the cracks are prevented around the outer circumference of the central core assembly 13 and especially at the secondary spool 20 and the epoxy resin 26 in the vicinity of the two end corners of the central core assembly 13, where the cracks might otherwise be liable to occur, so that the electric discharge between the high voltage side and the central core assembly 13 can be prevented. This makes it possible to apply the desired high voltage to the ignition plug.

The thermal expansion coefficient of the cap 19, the secondary spool 20 and the epoxy resin 26 is different from or larger than that of the central core assembly 13 comprised of the core 12 and the permanent magnets 14 and 15. As the temperature lowers, therefore, the cap 19, the secondary spool 20 and the epoxy resin 26 contact to activate a force to contract the central core assembly 13 in the radial direction and in the longitudinal direction. Especially when the force is applied in the longitudinal direction of the central core assembly 13, a magneto-striction to lower the magnetic permeability of the core 12 may occur to lower the voltage to be generated in the secondary coil 21. Since the central core assembly 13 is covered at its outer circumference with the cylindrical part 17*a* and partially at its two longitudinal ends with the annular parts 17*b* and 17*c* thicker than the cylindrical member 17, however, this cylindrical member 17 is elastically deformed to buffer the forces to be received by the central core assembly 13 in the radial direction and in the longitudinal direction so that no magneto-striction occurs in the core 12. As a result, the desired high voltage can be applied to the ignition plug.

The permanent magnets 14 and 15 are arranged in the first embodiment at the two longitudinal ends of the core 12, but the permanent magnet may be arranged at only one end of the core 12.

Second Embodiment

Figure 5:
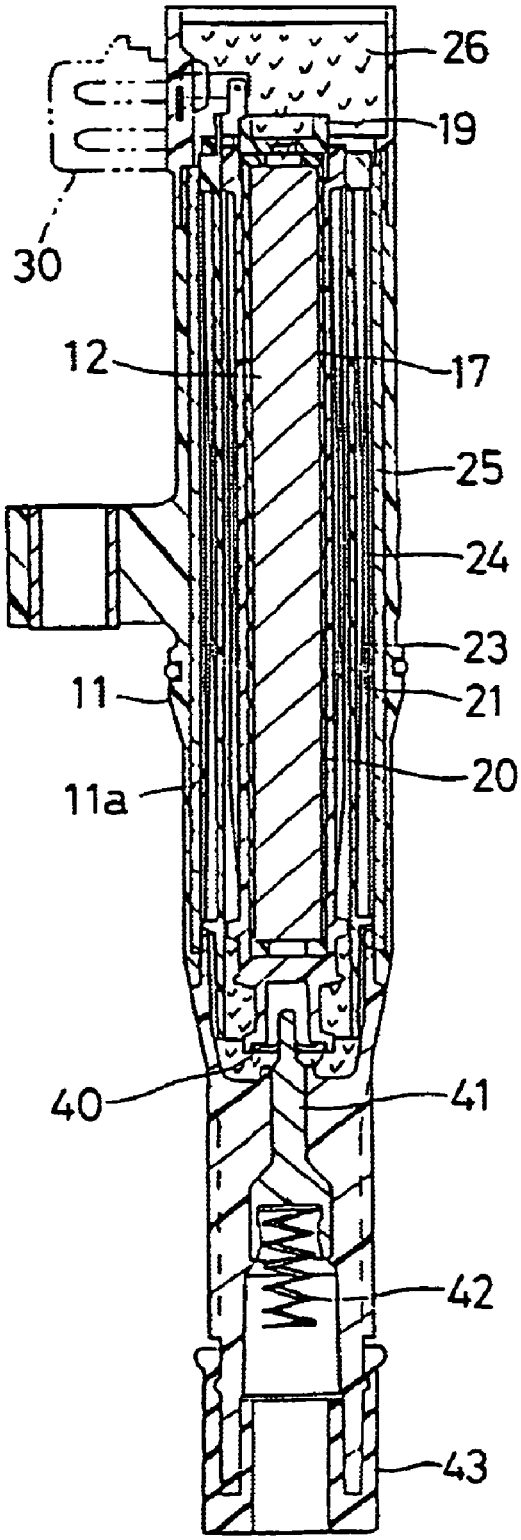
FIG. 5 is a longitudinal sectional view showing an ignition coil according to the second embodiment of the invention.

In the second embodiment shown in FIG. 5, no the permanent magnets are arranged at the two longitudinal ends of the core 12, but the core 12 itself provides the central core assembly 13. The core 12 is covered partially at the outer circumference, at the two end corners and at the two longitudinal end faces with the cylindrical member 17.

In the second embodiment, too, the cracks can be prevented around the outer circumference of the core 12 and especially at the secondary spool 20 and the epoxy resin 26 in the vicinity of the two end corners of the core 12, where the cracks might otherwise be liable to occur, so that the electric discharge between the high voltage side and the central core assembly 13 can be prevented. As a result, the desired high voltage can be applied to the ignition plug.

As a result of the elastic deformation of the cylindrical member 17, moreover, the forces for the core 12 to receive in the radial direction and in the longitudinal direction are buffered to establish no magneto-striction in the core 12. Thus, the desired high voltage can be applied to the ignition plug.

Third Embodiment

Figure 6:
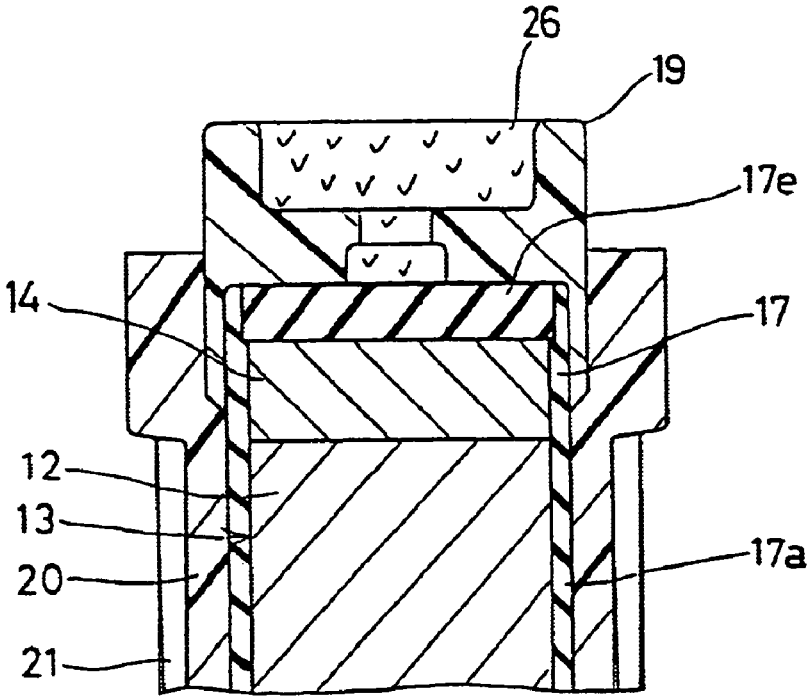
FIG. 6 is an enlarged sectional view showing one end portion of the ignition coil according to the third embodiment.
Figure 7:
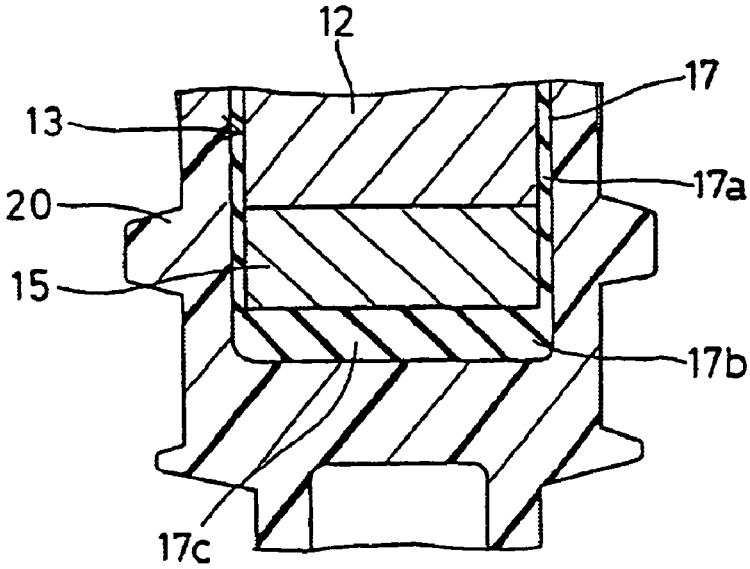
FIG. 7 is an enlarged sectional view showing the other end portion of the ignition coil according to the third embodiment.

In the third embodiment shown in FIGS. 6 and 7, the cylindrical member 17 made of rubber to act as the first buffer member is comprised of the cylindrical part 17*a*, an angled part 17*b* and a bottom disc part 17*c* acting as a second buffer member, and is shaped into a bottomed cylindrical shape, as closed at the bottom longitudinal end side of the permanent magnet 15. The cylindrical part 17*a* covers the outer circumference of the central core assembly 13, the annular angled part 17*b* covers the end corner of the permanent magnet 15, and the disc part 17*c* covers the bottom end face of the permanent magnet 15. The cylindrical member 17 is extended upwardly at the side of the permanent magnet 14 over the end face of the permanent magnet 14. A plate member 17*e* made of rubber to act as the first buffer member and the second buffer member is formed into a disc shape separate from the cylindrical member 17 and has a larger diameter than the permanent magnet 14. The end corner of the permanent magnet 14 is covered with the cylindrical member 17 and the plate member 17*e*, and the longitudinal top end face of the permanent magnet 14 is covered with the plate member 17*e*. Moreover, this plate member 17*e* effects a sealing between the cap 19 acting as the case member and the permanent magnet 14 so that the epoxy resin 26 will not enter the central core assembly 13.

In the third embodiment, too, the cracks can be prevented around the outer circumference of the central core assembly 13 and especially at the secondary spool 20 and the epoxy resin 26 in the vicinity of the two end corners of the central core assembly 13, where the cracks might otherwise be liable to occur, so that the electric discharge between the high voltage side and the central core assembly 13 can be prevented. As a result, the desired high voltage can be applied to the ignition plug.

As a result of the elastic deformations of the cylindrical member 17 and the plate member 17*e*, moreover, the forces for the central core assembly 13 to receive in the radial direction and in the longitudinal direction are buffered to establish no magneto-striction in the central core assembly 13. As a result, the desired high voltage can be applied to the ignition plug.

The first buffer member is comprised of the cylindrical member 17 and the plate member 17*e*, and the cylindrical member 17 is formed into the bottomed cylindrical shape having no longitudinal end face at its longitudinal top end, so that the first buffer member can be easily provided.

Fourth Embodiment

Figure 8:
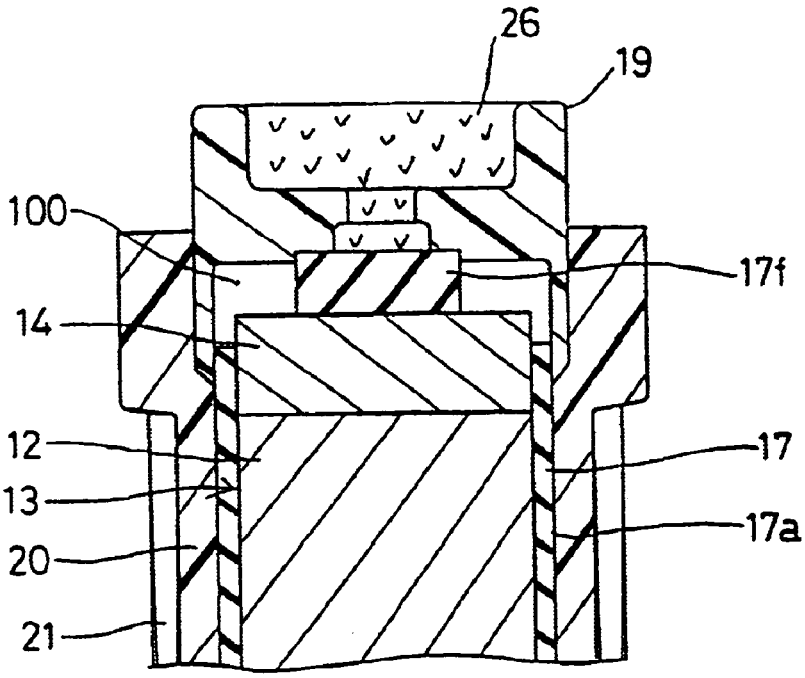
FIG. 8 is an enlarged sectional view showing one end portion of an ignition coil according to the fourth embodiment.
Figure 9:
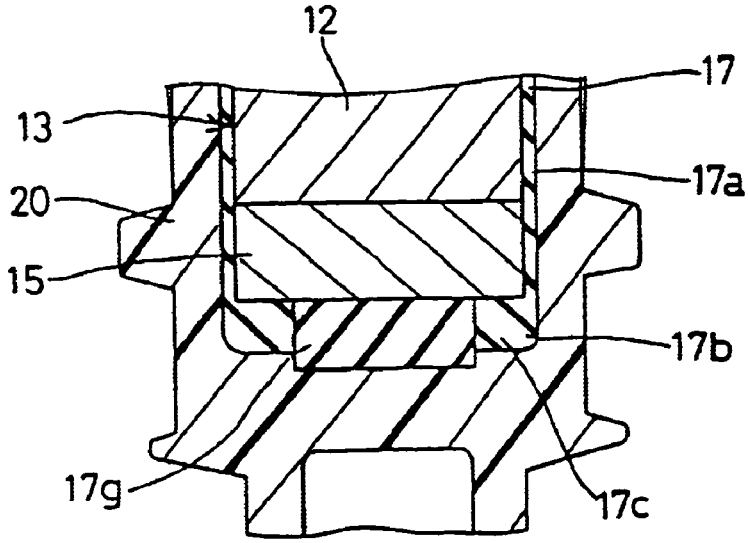
FIG. 9 is an enlarged sectional view showing the other end portion of the ignition coil according to the fourth embodiment.
Figure 10:
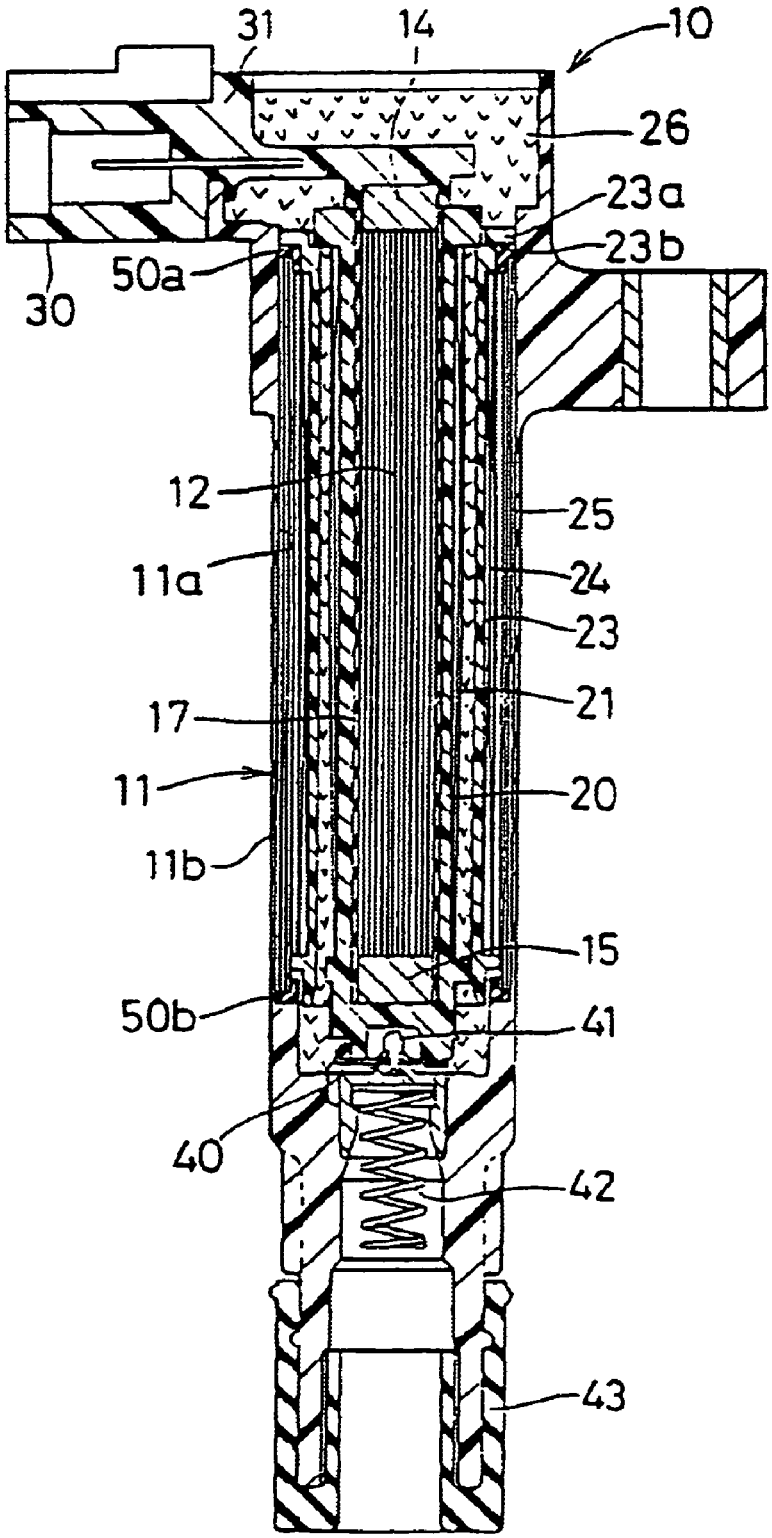
FIG. 10 is a sectional view showing an ignition coil according to the fifth embodiment of the invention.
Figure 13:
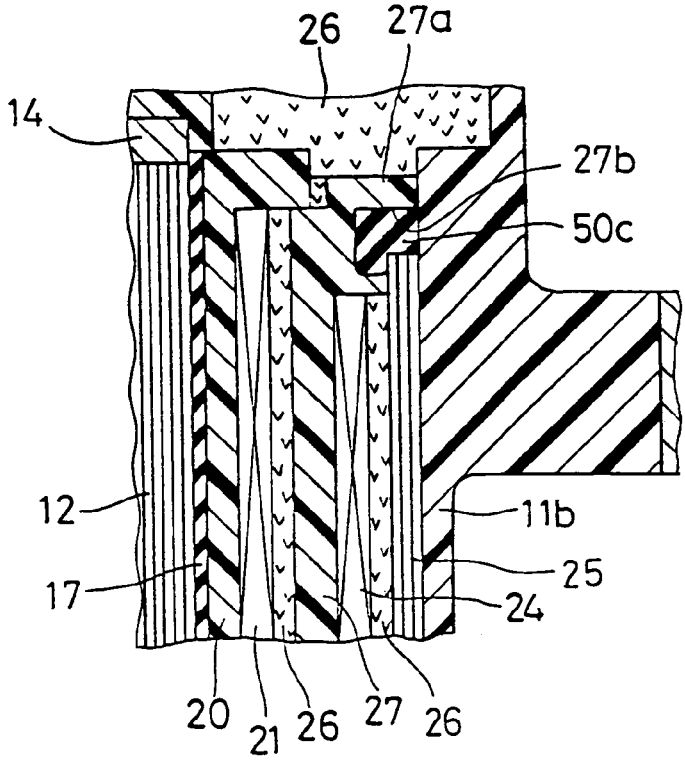
FIG. 13 is an enlarged sectional view showing the low voltage side of an ignition coil according to a sixth embodiment of the invention.
Figure 14:
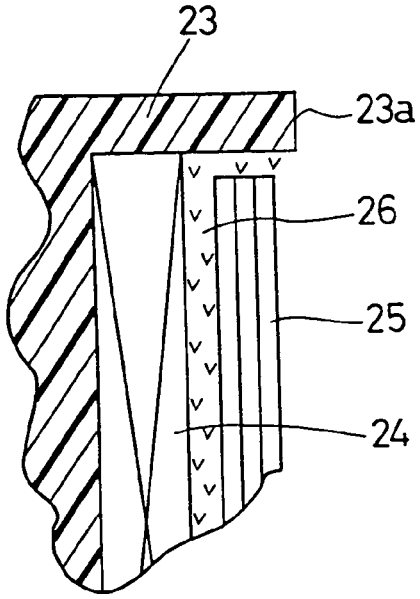
FIG. 14 is an enlarged sectional view showing the low voltage side of an ignition coil according to a seventh u embodiment of the invention.

In the fourth embodiment shown in FIGS. 8 and 9, the cylindrical member 17, as made of rubber to act as the first buffer member, is comprised of the cylindrical part 17*a*, the angled part 17*b* and the annular part 17*c*, and is formed into a cylindrical tube shape. The cylindrical part 17*a* covers the outer circumference of the central core assembly 13, the annular angled part 17*b* covers the end corner of the permanent magnet 15, and the annular part 17*c* covers a portion of the longitudinal bottom end face of the permanent magnet 15. The cylindrical part 17*a* extends to the circumferential side of the permanent magnet 14, but its end portion falls short of the top end face of the permanent magnet 14.

Plate members 17*f* and 17*g* made of rubber to act as the second buffer member are formed into a circular shape separate from the cylindrical member 17. The plate members 17*f* and 17*g* are made radially smaller than the permanent magnets 14 and 15 and are in abutment against the longitudinal end faces of the permanent magnets 14 and 15, respectively.

As shown in FIG. 8, the end corner of the permanent magnet 14 is surrounded by a space 100 and is kept out of contact with any member. Moreover, the plate member 17*f* effects a sealing between the cap 19 as the case member and the permanent magnet 14 so that the epoxy resin 26 will not enter the central core assembly 13.

In the fourth embodiment, the end corner of the permanent magnet 14 confronts the space 100, and the end corner of the permanent magnet 15 is covered with the cylindrical member 17, so that the two longitudinal end corners of the central core assembly 13 are out of contact with the secondary spool 20 and the epoxy resin 26. Since the outer circumference of the central core assembly 13 is covered with the cylindrical part 17*a*, moreover, even if the central core assembly 13 and the secondary spool 20 or the epoxy resin 26 having different thermal expansion coefficients repeat expansions and contractions in accordance with the temperature change, the cracks are prevented around the outer circumference of the central core assembly 13 and especially at the secondary spool 20 and the epoxy resin 26 in the vicinity of the two end corners of the central core assembly 13, where the cracks might otherwise be liable to occur, so that the discharge between the high voltage side and the central core assembly 13 can be prevented. This makes it possible to apply the desired high voltage to the ignition plug.

As a result of the elastic deformations of the plate members 17*f* and 17*g*, moreover, the forces for the central core assembly 13 to receive in the radial direction and in the longitudinal direction are buffered so that the magneto-striction will not occur in the central core assembly 13. Thus, the desired high voltage can be applied to the ignition plug. Moreover, the plate member 17*f* as the second buffer member acts as the seal member between the end face of the permanent magnet 14 and the cap 19 so that the number of parts and the number of assembling steps are reduced.

Only the end corner at the side of the permanent magnet 14 is disposed in the space 100 and kept out of contact with other members. However, only the end corner of the permanent magnet 15 may be surrounded by a space or both of the end corners of the permanent magnets 14 and 15 may be surrounded by respective spaces.

In the foregoing first to fourth embodiments, at least one of the outer circumference and the two longitudinal end corners of the central core assembly 13 is covered with the buffer member such as the cylindrical member 17, and the other is either covered with the cylindrical member 17 or made to be surrounded by the space. As a result, the secondary spool 20 and the epoxy resin 26 having the thermal expansion coefficient different from that of the central core assembly 13 are prevented from contacting with the outer circumference and the two end corners of the central core assembly 13, and the difference in the thermal expansion coefficients is absorbed by the elastic deformation of the buffer member. As a result, even if the central core and the secondary spool 20 or the epoxy resin 26 having different expansion coefficients repeat expansions and contractions in accordance with the temperature change, the cracks are prevented around the outer circumference of the central core and especially at the secondary spool 20 and the epoxy resin 26 in the vicinity of the two longitudinal end corners of the central core, where the cracks might otherwise be liable to occur. Thus, the discharge between the high voltage side in the ignition coil and the central core or the low voltage side can be prevented, as might otherwise occur along the cracks, so that the desired high voltage can be applied to the ignition plug.

Moreover, the outer circumference of the central core assembly 13 is covered with the cylindrical member 17, and the two longitudinal end faces of the central core assembly 13 are covered with either the cylindrical member 17 or the plate members 17*e*, 17*f*, 17*g* acting as the buffer member. Even if the secondary spool 20 or the epoxy resin 26 having the thermal expansion coefficient different from that of the central core are expanded or contracted together with the central core assembly 13 as the temperature changes, the cylindrical member 17 and the plate members 17*e*, 17*f*, 17*g* are elastically deformed to buffer the forces to be received by the central core assembly 13 in the radial direction and in the longitudinal direction are buffered. As a result, no magneto-striction will be caused in the central core assembly 13 so that the desired high voltage can be applied to the ignition plug.

Although the cylindrical member 17 acting as the buffer member is extended in the longitudinal direction of the central core assembly 13 and shaped to cover at least one end corner and the outer circumference of the central core assembly 13, the buffer member may be comprised of a plurality of members to cover only the longitudinal end corners of the central core assembly 13.

Although the cylindrical member 17 and the plate members 17*e*, 17*f*, 17*g* are molded of rubber, the cylindrical member 17 and the plate members 17*e*, 17*f*, 17*g* can be molded of an elastomer resin, and the cylindrical member 17 can be insert-molded to have the central core assembly 13 integrally therein. Alternatively, the central core assembly 13 may be inserted into the cylindrical member 17 which is molded of the elastomer resin.

Further, the cylindrical member 17 as the buffer member may be provided by covering the surface of the central core assembly 13 with an elastic member of an elastomer resin or rubber by the integral molding method such as the injection molding, baking or dipping method. In this case, the cylindrical member may cover the whole surface of the central core assembly 13 or may have a small through hole formed at one longitudinal end portion for discriminating the end specified one end portion of the central core assembly 13. By molding the central core assembly 13 and the cylindrical member 17 integrally, the cylindrical member does not come out of the central core assembly 13 during the assembling process.

Alternatively, the cylindrical member 17 may be provided by mounting the permanent magnets 14 and 15 in advance on the core 12 to construct the central core assembly 13 and by covering the central core assembly 13 with a thermally shrinking tube to shrink this tube thermally.

Further, the cylindrical member 17 contacting with the end corners of the central core assembly 13 may be prevented from any damage by chamfering the end corners of the central core assembly 13, i.e., the end corners of the permanent magnets 14 and 15 by polishing or the like.

Fifth Embodiment

In the fifth embodiment shown in FIGS. 11 and 12, at the end portion of the primary spool 23, as located at the low voltage side of the secondary coil 21, there is formed a flange 23*a* which is bulged radially outward and which has a fitting portion 23*b* formed to have an L-shaped section for fitting a ring member 50*a* therein.

The inner circumference corners of the two longitudinal end portions of the outer core 25 are covered with ring members 50*b* and 50*a* which are made of rubber to act as angled members. The inner circumference of the end portion of the outer core 25, as located at the high voltage side of the secondary coil 21, is covered with the ring member 50, whereas the inner circumference corner of the end portion of the outer core 25, as located at the low voltage side of the secondary coil 21, is covered with the ring member 51. As shown in FIG. 11, the ring member 50*a* is fitted in the fitting portion 23*b* which is formed in the flange 23*a*. Before the ring member 50*a* is fitted in the fitting portion 23*b*, the internal diameter of the ring member 50*a* is set to be slightly smaller than the external diameter of the outer circumference of the fitting portion 23*b*. As a result, the elastic force of the ring member 50*a* acts upon the fitting portion 23*b* inward in the radial direction.

The ignition coil 10 is assembled as follows.

(1) The ring member 50*b* is fitted in one end portion of the outer core 25, and this outer core 25 is inserted from the side of the ring member 50*b* into the transformer portion 11*b* having the high voltage terminal 41 and the spring 42. The ring member 50*b* is retained by the retaining portion 13*a* of the transformer portion 11*b*, as shown in FIG. 12, to regulate the stroke of insertion of the outer core 25.

(2) The coil assembly, as constructed of the central core assembly 13, the permanent magnets 14 and 15, the secondary spool 20, the secondary coil 21, the primary spool 23 having the ring member 50*a* fitted in the fitting portion 23*b*, and the primary coil 24, is inserted into the outer core 25. The ring member 50*a* is fitted in the fitting portion 23*b* by the radially inward elastic force so that it is less likely to get out of place from the fitting portion 23*b*. The ring member 50*a* is retained on the inner circumference corner of the end portion of the outer core 25 so that the stroke of insertion of the coil assembly is regulated.

(3) The cap is fitted on the transformer portion 11*b*, and the epoxy resin is poured from the opening 12*a* of a cap 31.

In the assembling procedure described above, the coil assembly including the outer core 25 may be inserted into the transformer portion 11*b* by assembling the outer core 25 with the coil assembly, and then by covering the inner circumference corner of the end portion of the outer core 25 at the low voltage side in advance with the ring member 51.

Here, the epoxy resin 26 has a larger thermal expansion coefficient than that of the outer core 25 made of a silicon steel sheet. If the inner circumference corners of the two end portions of the outer core 25 are not covered with the ring members 50*b* and 50*a* but are in direct contact with the epoxy resin 26, the ring members 50*b* and 50*a* and the epoxy resin 26 repeat the expansions and contractions as the temperature changes, so that cracks will occur in the epoxy resin 26 contacting with the inner circumference corners of the two end portions of the outer core 25. If the cracks occur in the epoxy resin 26 contacting with the inner circumference corners of the two end portions of the outer core 25, a discharge may occur through the cracks between the dummy coil 22, the terminal plate 40 or the high voltage terminal 41 at the high voltage side of the secondary coil 21 or the high voltage side and the outer core 25 or the low voltage portion. With this discharge between the high voltage portion and the low voltage portion, the voltage to be applied to the ignition plug drops so that the desired high voltage cannot be applied to the ignition plug.

In the Fifth embodiment, however, the inner circumference corners of the two end portions of the outer core 25 are covered with the ring members 50*b* and 50*a* made of rubber, so that they are prevented from contacting directly with the epoxy resin 26. Moreover, the difference in the expansion coefficient between the outer core 25 and the epoxy resin 26 can be absorbed by the elastic deformations of the ring members 50*b* and 51. As a result, no crack occurs in the epoxy resin 26 in the vicinity of the inner circumference corners of the two end portions of the outer core 25 so that the discharge can be suppressed between the high voltage side of the secondary coil 21, i.e., the dummy coil 22, the terminal plate 40 or the high voltage terminal 41 and the outer core 25. As a result, the desired high voltage can be applied to the ignition plug.

Moreover, the ring member 50*a* can be fitted in the fitting portion 23*b* of the primary spool 23 so that the ring member 50*a* is less likely to come out of the primary spool 23 when this primary spool 23 is inserted into the outer core 25. As a result, the assemlability of the ring member 50*a* is improved to reduce the number of assembling steps.

Sixth Embodiment

In the sixth embodiment, at the end portion of a primary spool 27, as located at the low voltage side of the secondary coil 21, there is formed the flange 23*a*, in which an annular groove 27*b* is formed as the fitting portion for fitting the ring member 50*c* as the angled member. When the ring member 50*c* is fitted in the annular groove 27*b*, its longitudinal motion is regulated so that the ring member 50*c* is less likely to get out of position when the primary spool 27 is inserted into the outer core 25. As a result, the assembly of the primary spool 27 having the ring member 50*c* fitted therein is further facilitated to reduce the number of assembling steps. The inner circumference corner, as located at the high voltage side of the secondary coil 21, of the end portions of the outer core 25 is covered with the ring member 50*b* as in the fifth embodiment.

In the Fifth embodiment and the second embodiment described above, the ring member as the angled member covers the inner circumference corners of the two longitudinal end portions of the outer core 25 thereby to prevent the epoxy resin 26 from coming into direct contact with the inner circumference corners of the two end portions of the outer core 25. As a result, the cracks are suppressed in the epoxy resin 26 in the vicinity of the inner circumference corners of the two end portions of the outer core 25 due to the temperature change. By making the ring members of an elastic material such as rubber, moreover, the difference in the expansion coefficient between the outer core 25 and the epoxy resin 26 is absorbed by the elastic deformation of the ring members so that the cracks are made further less likely to occur. As a result, the discharge between the high voltage side of the secondary coil 21 or the high voltage portion such as the dummy coil 22, the terminal plate 40 or the high voltage terminal 41 and the outer core 25 or the low voltage portion can be suppressed to apply the desired high voltage to the ignition coil. On the other hand, not the whole surface of the outer core 25 but only the inner circumference corner of its end portion is covered with the ring member so that the radius of the ignition coil is not enlarged.

The ring member as the angled member is made of rubber in the fifth embodiment and sixth embodiment, but the rubber may be replaced by an elastomer resin. Moreover, the ring member may be made of a hard resin or the like in place of the elastic material if the inner circumference corner of the end portion of the outer core can be covered with a cured face.

If the angled member is made of a volumetrically shrinkable material such as independently foamed sponge, on the other hand, this sponge is easily deformable so that the sponge abutting against the outer core can be deformed in its section into an L-shape conforming the shape of the inner circumference corner of the end portion of the outer core by applying the outer core to the independently foamed sponge thereby to cover the inner circumference corner of the end portion of the outer core. As a result, the angled member can be formed in its sectional shape not into the L-shape in advance but into the simple plate shape so that it can be easily worked.

The ring members cover the inner circumference corners of the two end portions of the outer core 25 in the embodiments but can cover only the inner circumference corner of one end portion of the outer core 25. Moreover, with no radial restriction, the end portion of the outer core, as located at the low voltage side of the secondary coil, for example, may be covered with a ring member having a C-shaped section.

Seventh Embodiment

In the seventh embodiment, the inner circumference corner of the end portion of the outer core 25 is not covered with the ring member, but the end portion of the primary spool 23, as located at the low voltage side of the secondary coil 21, is extended longer in the longitudinal direction than the outer core 25. Moreover, the flange 23*a*, as formed at the end portion of the primary spool 23 at the low voltage side of the secondary coil 21, is more extended in the radial direction than the end portion of the outer core 25 thereby to cover the end portion of the outer core 25. The inner circumference corner of the end portion of the outer core 25, as located at the high voltage side of the secondary coil 21, is covered with the ring member 50*b* (not shown) as in the fifth embodiment.

In the seventh embodiment, the cracks, if caused in the epoxy resin 26 in the vicinity of the corner of the end portion of the outer core 25, are shielded by the flange 23*a* so that they become less likely to extend. As a result, the cracks fail to reach the electric wires connecting the secondary coil 21 and the primary coil 24, and the terminals which are arranged in the ignition coil, so that the electric wires can be prevented from being broken by the cracks. Moreover, the discharge is suppressed through the cracks between the high voltage side of the secondary coil or the high voltage terminal and the outer core 25 so that the desired high voltage can be applied to the ignition plug.

If the primary spool is extended at its flange as short as the radially inner side of the outer core 25 but at its end portion at the low voltage side of the secondary coil longer in the longitudinal direction than the outer core 25, it can prevent the cracks from extending to the inner circumferential side of the primary spool. As a result, the breakage of the electric wires can be prevented to suppress the discharge.

Figure 15:
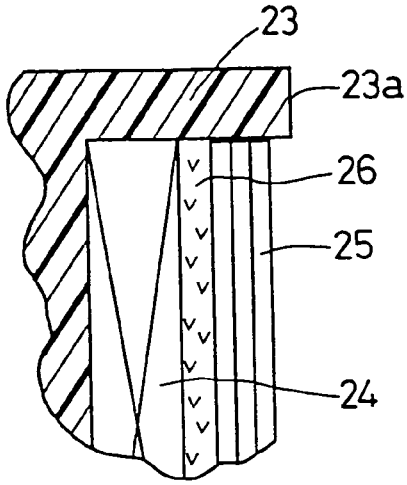
FIG. 15 is an enlarged sectional view showing the low voltage side of an ignition coil according to a modification of the seventh embodiment.

In a modification of the shown in FIG. 15, the end portion of the outer core 25 is held in contact with and covered with the flange 23*a* of the primary spool 23. Since the inner circumference corner of the end portion of the outer core 25 hardly contacts with the epoxy resin 26, the cracks are prevented from occurring in the epoxy resin 26, and the cracks, if caused in the epoxy resin 26 in the vicinity of the inner circumference corner of the end portion of the outer core 25, can be prevented from extending.

In the seventh embodiment and its modification, the inner circumference corner of the end portion of the outer core 25, as covered with the primary spool, is not covered with the ring member. However, the end portion of the outer core 25, as covered with the ring member, is further covered with the ring member, which is covered with the flange of the primary spool.

On the other hand, the inner circumference of the end portion of the outer core 25 at the high voltage side of the secondary coil is not covered with the ring member 50*b* but may be covered with the flange of the primary spool or the outer spool. When the secondary coil 21 is arranged around the outer circumference of the primary coil 24, too, the inner circumference corners of the end portions of the outer core 25 at the low voltage side and the high voltage side of the secondary coil are not covered with the ring members but may be covered with the flange of the secondary spool. If the inner circumference corner of the end portion of the outer core 25 at the high voltage side of the secondary coil is not covered with the ring member, the cracks may occur in the epoxy resin 26 in the vicinity of the inner circumference corner of the end portion of the outer core 25 thereby to establish the discharge between the high voltage side of the secondary coil 21 and the outer core 25. However, the cracks, if any, are shielded by the flange of the secondary spool or the outer spool and are suppressed from any extension so that the discharge can be suppressed between another high voltage portion and the outer core 25. Moreover, the electric wires, if any at the high voltage side of the secondary coil, can be prevented from breaking.

In the above plural embodiments of the invention thus far described, the ring member to come into contact with the corner of the end portion of the outer core 25 can be prevented from any damage by rounding the same end portion corner by chamfering it by the indenting or machining method. When the end portion of the corner of the outer core 25 is not covered with the ring member, too, the cracks can be suppressed in the epoxy resin 26 in the vicinity of the end portion corner of the outer core 25.

The primary coil 24 is arranged around the outer circumference of the secondary coil 21 in the foregoing plural embodiments, but the secondary coil 21 may be arranged around the outer circumference of the primary coil 24.

Eighth Embodiment

Figure 16:
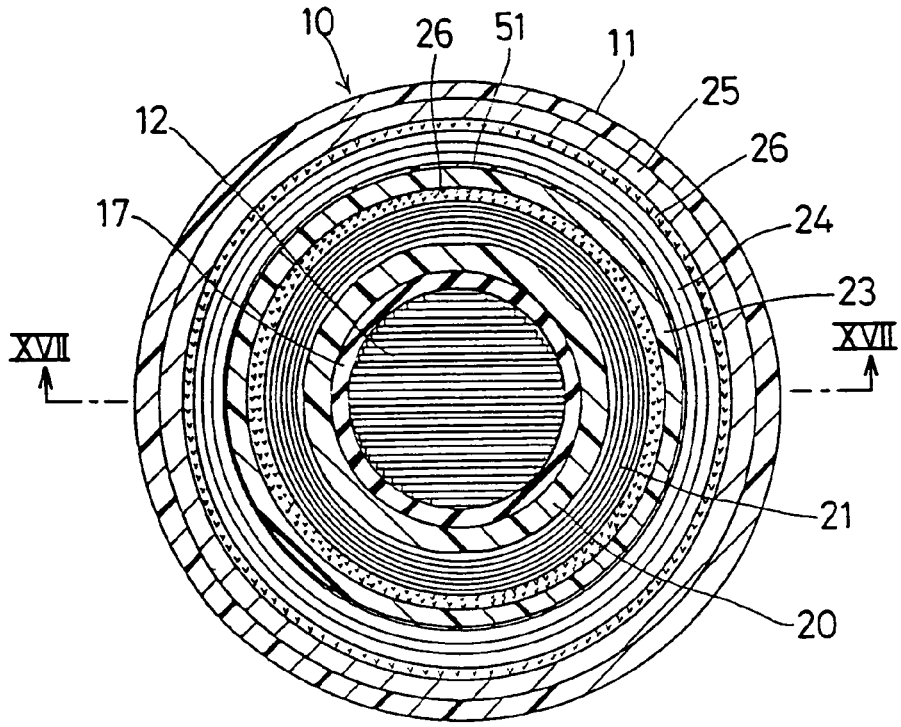
FIG. 16 is a transverse sectional view showing an ignition coil according to the eighth embodiment of the invention.
Figure 17:
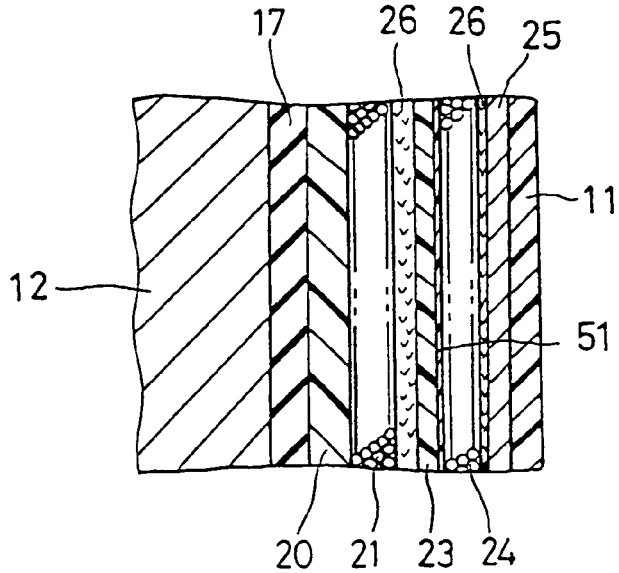
FIG. 17 is an enlarged sectional view of a part of the ignition coil according to the eighth embodiment, the view being taken along a line XVII—XVII in FIG. 16.
Figure 18:
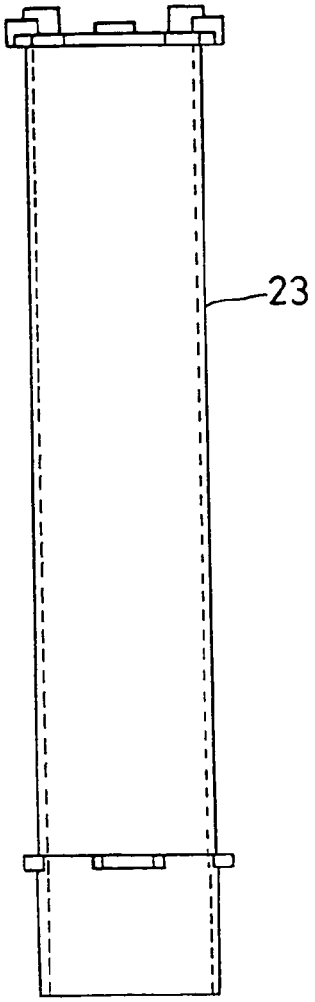
FIG. 18 is a front view showing a primary spool used in the eighth embodiment.
Figure 19:
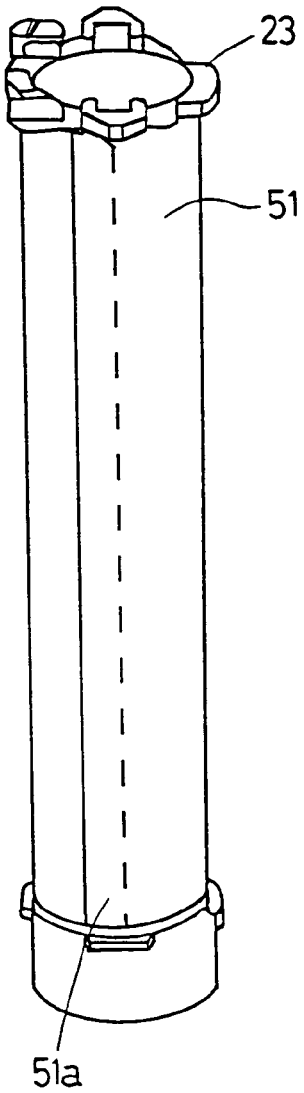
FIG. 19 is a perspective view showing a film on the primary spool used according to a variation of the eighth embodiment.
Figure 20:
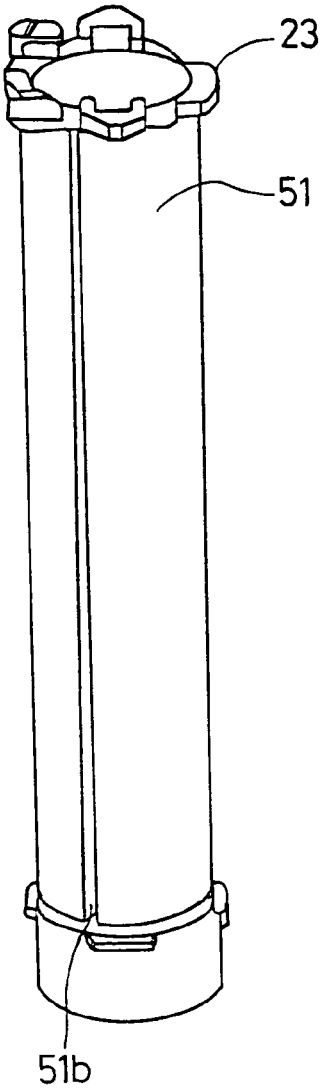
FIG. 20 is a perspective view showing the film on the primary spool according to another variation of the eighth embodiment.

In the eighth embodiment shown in FIGS. 16 and 17, the primary spool 23 is disposed on the outer periphery of the secondary coil 21 and is formed of a resin material. A thin film 51 as a separating member made of PET (polyethylene terephthalate) for example is wrapped around the outer periphery of the primary spool 23 shown in FIG. 18. The primary coil 24 is wound around the outer periphery of the thin film 51. The thin film 51 may be wrapped by overlapping a wrap end 51*a* as shown in FIG. 19 or by leaving a gap 51*b* as shown in FIG. 20. The thin film 51 formed of PET adheres less with both of the primary spool 23 and epoxy resin 26. Accordingly, the primary spool 23 and the primary coil 24 can expand/contract separately without restraining each other when the primary spool 23 and the primary coil 24 whose thermal expansion coefficients differ expand/contract as the surrounding temperature changes.

The outer core 25 is attached around the outer periphery of the primary coil 24. Because the outer core 25 is formed by wrapping a thin silicon steel plate cylindrically around the primary coil 24 so that its wrap starting end is not connected with its wrap ending end, a gap is provided in the longitudinal direction. The outer core 25 extends from the peripheral position of the permanent magnet 14 (FIG. 1) to the peripheral position of the permanent magnet 15 in the longitudinal direction.

In the above eighth embodiment, the thin film 51 interposed between the primary spool 23 and the primary coil 24 adheres less with the epoxy resin 26 which has infiltrated between coil wires of the primary coil 24 and the primary spool 23. Accordingly, when each member of the ignition coil 10 expands/contracts as the ambient temperature changes, (1) the members on the inner periphery side of the thin film 51, i.e., the primary spool 23, the secondary coil 21, the secondary spool 20, the central core assembly 13 and the epoxy resin 26 on the inner periphery side of the thin film 51 and (2) the members on the outer periphery side of the thin film 51, i.e., the primary coil 24, the outer core 25, the housing 11 and the epoxy resin 26 on the outer periphery side of the thin film 51 expand/contract separately from each other bordering on the thin film 51. Thereby, the force which acts on each other when the inner and the outer peripheral parts of the thin film 51 expand/contract is divided by the thin film 51. Accordingly, the force which acts on the inner peripheral part which is otherwise liable to receive the greater force than the outer peripheral part when they expand/contract is reduced, so that the distortion of the inner peripheral part is reduced. For instance, because the distortion of the secondary spool 20 as a member composing the inner peripheral part is reduced, it is possible to prevent the secondary spool 20 from cracking in low temperature when the toughness of the secondary spool 20 drops. Thereby, it is possible to prevent the electric discharge from occurring between the coil wires composing the secondary coil 21 along the crack which might otherwise be caused in the secondary spool 20 and to prevent the electric discharge between the secondary coil 21 and the central core assembly 13 as well as the dielectric breakdown between the secondary coil 21 and the central core assembly 13 from occurring. Accordingly, desired high voltage is generated by the secondary coil 21 and the high voltage causes the ignition plug to generate a good spark.

Because it is possible to reduce the distortion of not only the secondary spool 20 but also of the epoxy resin 26 as the inner peripheral part filled between the secondary spool 20 and the core 12 caused by the expansion/contraction and to prevent the crack from occurring at the surface of contact with the core 12, it is possible to prevent the insulation between the secondary coil 21 and the core 12 from being broken.

Ninth Embodiment

Figure 21:
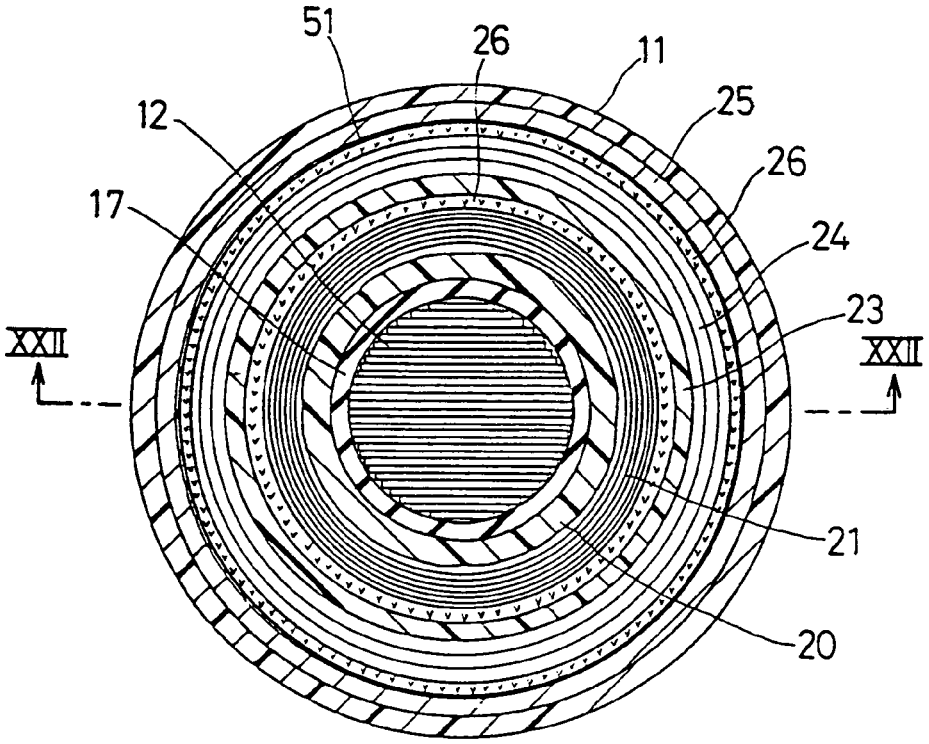
FIG. 21 is a transverse sectional view showing an ignition coil according to the ninth embodiment of the invention.
Figure 22:
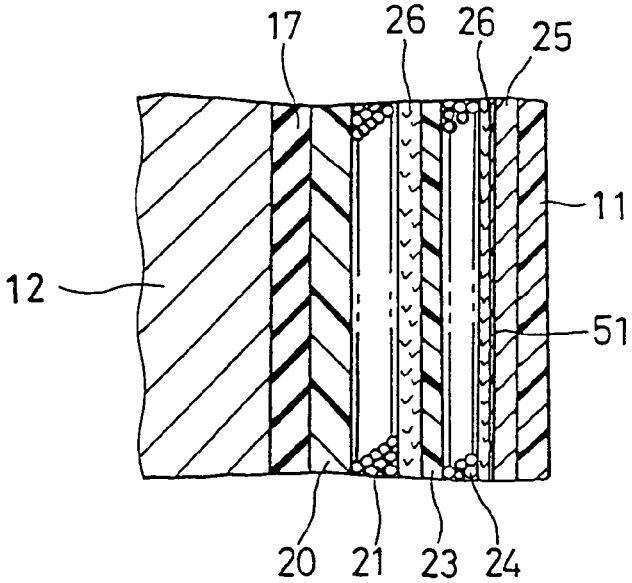
FIG. 22 is an enlarged sectional view showing a part of the ignition coil according to the ninth embodiment, the view being taken along XXII—XXII in FIG. 21.

In the ninth embodiment shown in FIGS. 21 and 22, the thin film 51 is interposed between the primary coil 24 and the outer core 25. Although the position of the thin film 51 is different from that in the eighth embodiment, the force which acts on each other when the inner and outer peripheral parts expand/contract bordering on the thin film 51 is divided by the thin film 51 in the same manner as in the eighth embodiment. Accordingly, it is possible to prevent the member, e.g., the secondary spool 20, composing the inner peripheral part from cracking and to prevent dielectric breakdown within the ignition coil 10.

Although the PET thin film 51 is used as the separating member in the eighth and ninth embodiments, it is possible to form a separating member by applying PET as a separating material on the primary spool 23. Instead of PET, silicone, wax or the like may be used as the separating material to be applied on the primary spool 23. Also a rubber member may be wrapped around the primary spool 23 or the like or a rubber member formed in a shape of tube in advance may be fitted on the primary spool 23 or the like. Further, a plurality of thin films may be disposed at a plurality of sections.

Although the thin film 51 which adheres less with the spool and the epoxy resin 26 has been used as the separating member in the above embodiments, the use of a separating member which adheres less with at least either one of the spool and the epoxy resin 26 also allows the inner and outer peripheral parts of the ignition coil 10 to be separated so that those can expand/contract separately from each other bordering on the separating member.

Although the inner and outer peripheral parts of the ignition coil have been separated by using the thin film 51 in the above embodiments, the spool itself may be used as a separating member by forming the spool by PPS (polyphenylene sulfide) or PET forming the thin film 51. Thereby, because no separating member needs to be provided anew, the number of parts and the number of manufacturing steps may be reduced.

Further, it is possible to apply PET, silicone, wax or the like as a separating material to the primary coil 24 so that the epoxy resin 26 will not contact with the primary spool 23. It becomes possible to prevent the resin insulator in contact with the primary coil 24 from cracking by applying the separating material on the primary coil 24.

Instead of applying the separating material on the primary coil 24, the coil wires of the primary coil 24 may be coated by a material, e.g., nylon or fluorine, which does not adhere with the epoxy resin 26. Thereby, the primary coil 24 and the resin insulator 26 can expand/contract separately, so that the restraint added to the primary spool 23 via the resin insulator 26 from the the primary coil 24 is lowered when they expand/contract. Accordingly, it is possible to prevent the primary spool 23 and the resin insulator 26 in contact with the primary spool 23 from cracking.

Tenth Embodiment

Figure 23:
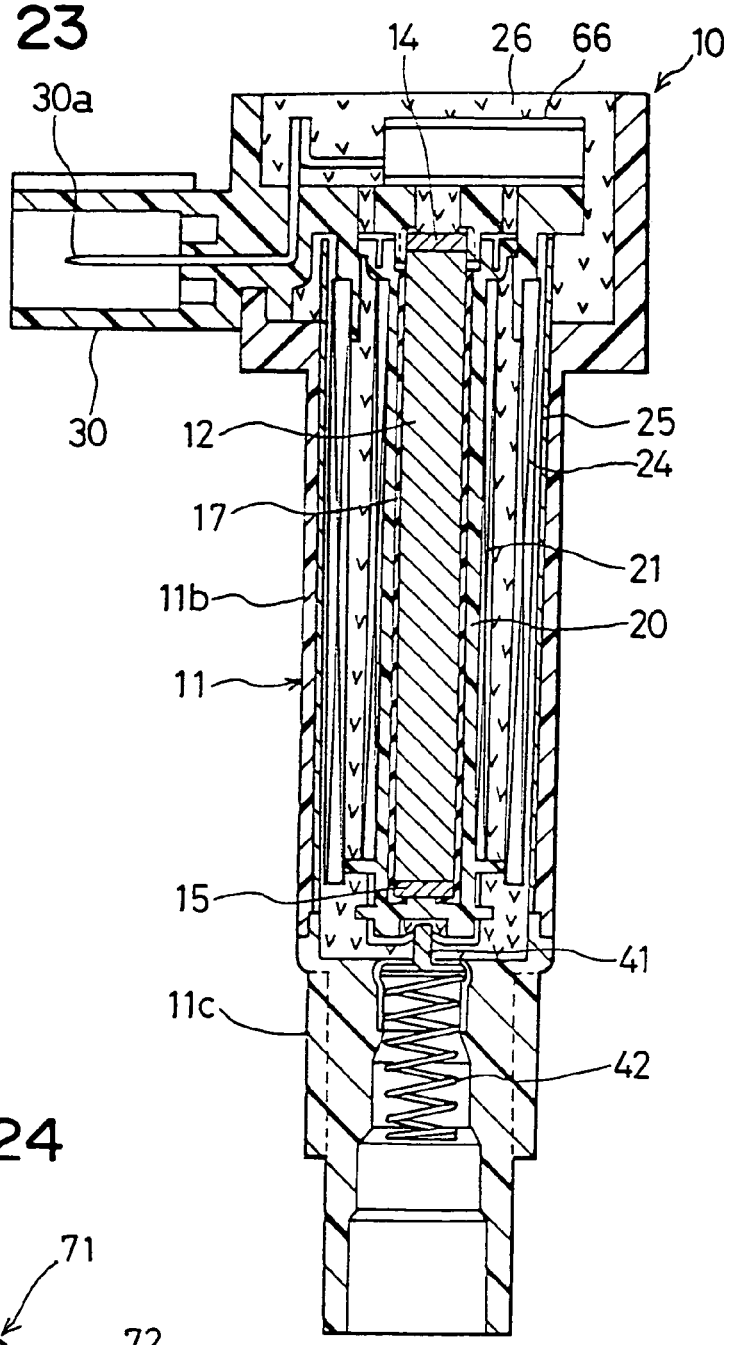
FIG. 23 is a longitudinal sectional view showing an ignition coil according to the tenth embodiment of the invention.

In the tenth embodiment shown in FIG. 23, the housing 11 of the ignition coil 10 has a first housing (transformer portion) 11*a* and a second housing (plug portion) 11*c*, and the connector 30 formed by inserting a plurality of terminals 30*a* is provided at an opening on the low voltage side of the first housing 11*b*. An electronic igniter circuit 66 as the switching circuit is provided within the ignition coil 10.

Figure 24:
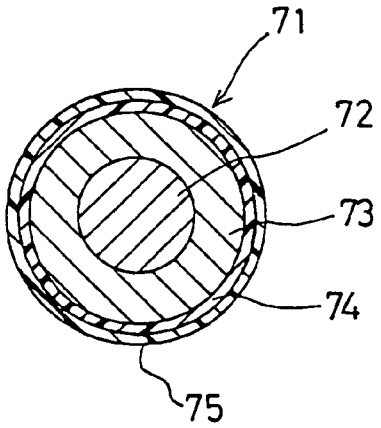
FIG. 24 is a transverse sectional view showing a coil wire of a primary coil before winding according to the tenth embodiment.

The primary coil 24 is made of a coil wire 71 which is constructed as shown in FIG. 24 before it is wound. The wire 71 is a self-fusing type. An insulating layer 73 is formed on the outer periphery of a copper wire material 72 which forms the main body of the wire 71, a separating layer 74 of nylon or fluorite is formed on the outer periphery of the insulating layer 73 as a separating material and a fusing layer 75 of a fusing material is formed on the outer periphery of the separating layer 74.

The fusing layer 75 melts and the wire 71 adhere each other by heating after winding the wire 71 around a temporary core member in a coil. When it is cooled in that state, the melted fusing material is solidified and the wire 71 is combined each other longitudinally, maintaining the shape of the tubular coil even if it is removed from the temporary core member. Accordingly, the primary coil 24 may be assembled without using a primary spool for the primary coil 24.

The primary coil 24 thus formed may be considered to have the same structure with a coil which is coated by the fusing material by its outer and inner peripheral sides and which is applied by the separating material within the fusing material. When the primary coil 24 and the epoxy resin 26 on the inner and outer peripheral sides of the primary coil 24 whose thermal expansion coefficient differ repeatedly expand/contract with changes in temperature, the fusing material expands/contracts together with the epoxy resin 26 because the fusing material adheres strongly with the epoxy resin 26. The separating material adheres less with the fusing material, so that the primary coil 24 is separated from the epoxy resin 26 on the inner and outer peripheral sides of the primary coil 24 bordering on the separating material and can expand/contract separately from each other.

Because the shape of the primary coil 24 can be maintained without winding it around the spool, the primary spool may be omitted and the diameter of the ignition coil 10 may be reduced in the radial thickness. Further, because the primary spool can be omitted, the number of parts and the production cost may be reduced.

Although the separating layer 74 is formed on the inner peripheral side and the fusing layer 75 has is formed on the outer peripheral side, the separating layer 74 may be formed on the outer peripheral side and the fusing layer 75 may be formed on the inner peripheral side. Further, one coating layer which possesses both separating and fusing qualities may be formed by mixing the separating material and the fusing material. It is also possible to form one coating layer which possesses both qualities by one material by using a separating material having the fusing quality or a fusing material having the separating quality. The separating member may be disposed on the inner or the outer peripheral side of the coils combined by the fusing material without forming the separating layer on the wire.

Although the fusing layer 75 is formed only on the primary coil 24 and the primary spool is omitted, the fusing layer may be formed only on the secondary coil or may be formed on both primary and secondary coils 24 and 21. In this case, the separating layer is formed on the coil on which the fusing layer is formed.

Although the secondary coil 21 is provided on the inner peripheral side of the primary coil 24 in the above embodiments, it is also possible to reverse the position of the primary coil 24 and the secondary coil 21 by disposing the secondary coil 21 on the outer peripheral side and the primary coil 24 on the inner peripheral side.

Eleventh Embodiment

Figure 25:
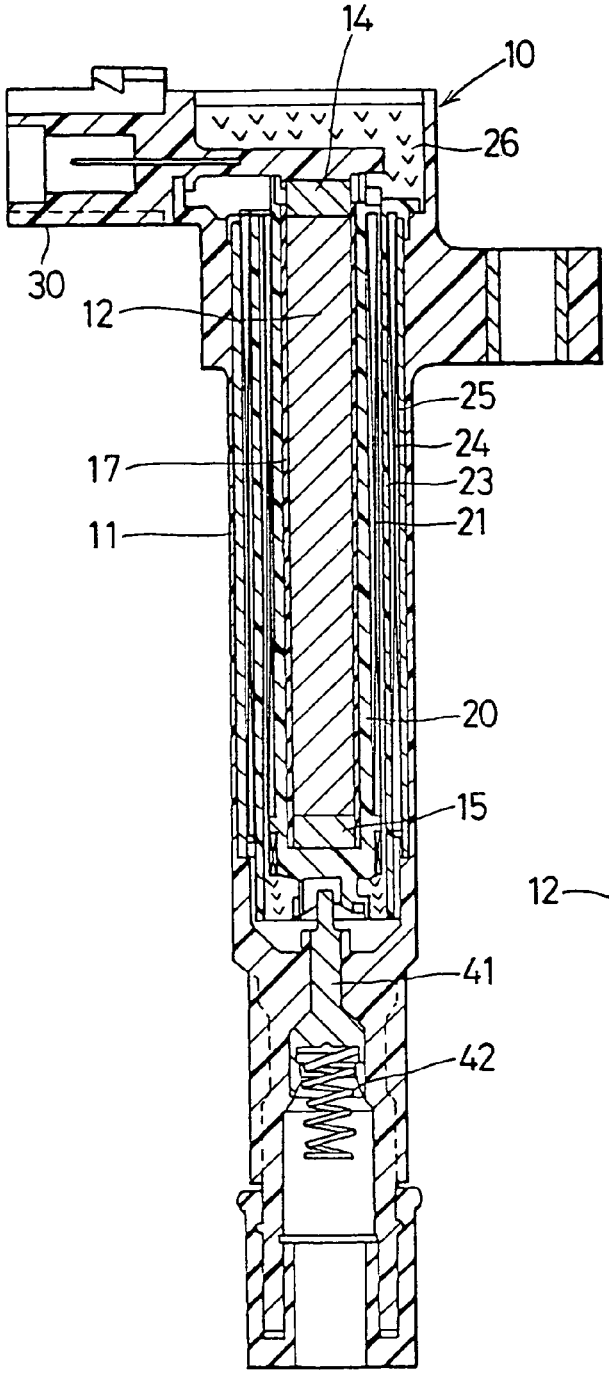
FIG. 25 is a longitudinal sectional view showing an ignition coil according to the eleventh embodiment of the invention.
Figure 26:
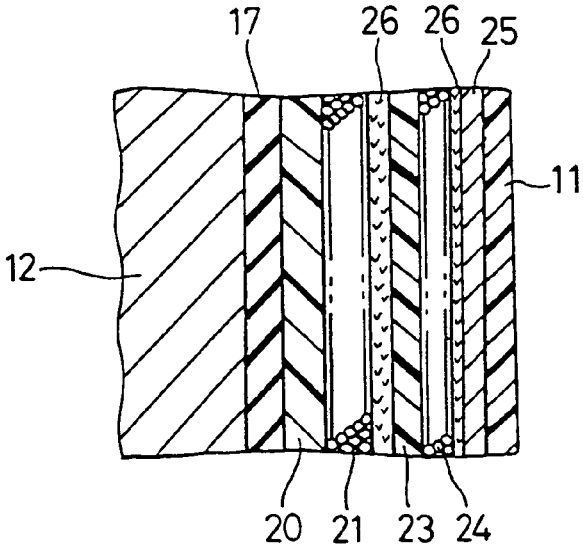
FIG. 26 is an enlarged sectional view showing a part of the eleventh embodiment shown in FIG. 25.

In the eleventh embodiment shown in FIGS. 25 and 26, the secondary spool 20 is disposed on the outer periphery of the cylindrical rubber member 17 and is formed of a resin material. The secondary coil 21 is disposed around the outer periphery of the secondary spool 20 and is electrically connected with the high voltage terminal 41. The primary spool 23 is disposed around the outer periphery of the secondary coil 21 and is formed of a resin material. The primary coil 24 is wound around the outer periphery of the primary spool 23.

Each of the primary and secondary spools 23 and 20 is molded of the resin material containing at least one of PPE, PS and PBT and whose solution viscosity is kept to be less than 0.5 and to which more than 5 weight % of SEBS (styrene-ethylene-butene-styrene) rubber for example as a rubber component whose glass transition point temperature Tg is −30° or less and glass fibers as a reinforcing material for preventing the plastic deformation of the spool are contained.

Figure 27:
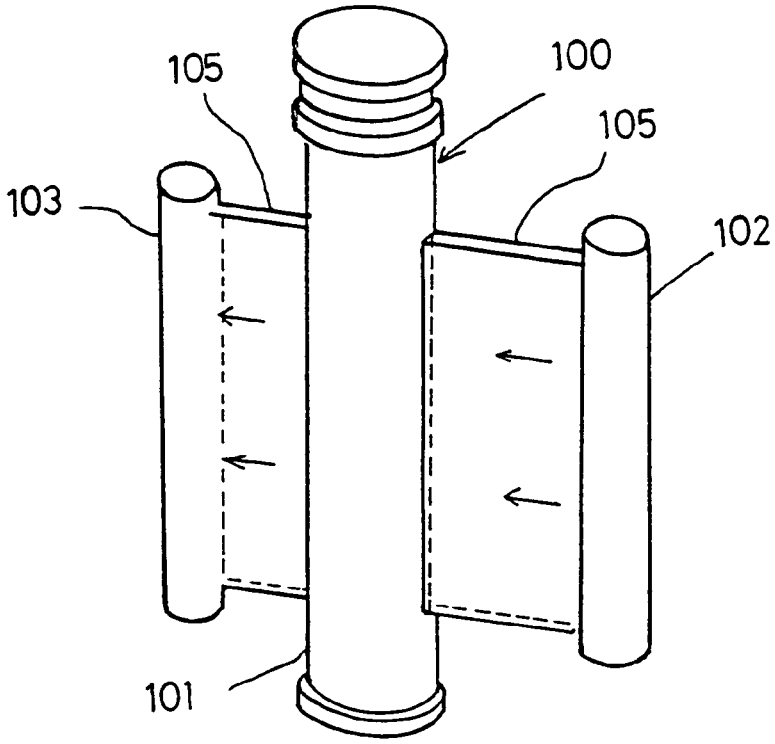
FIG. 27 is a perspective view showing a mold die for molding the spool in the eleventh embodiment.
Figure 28:
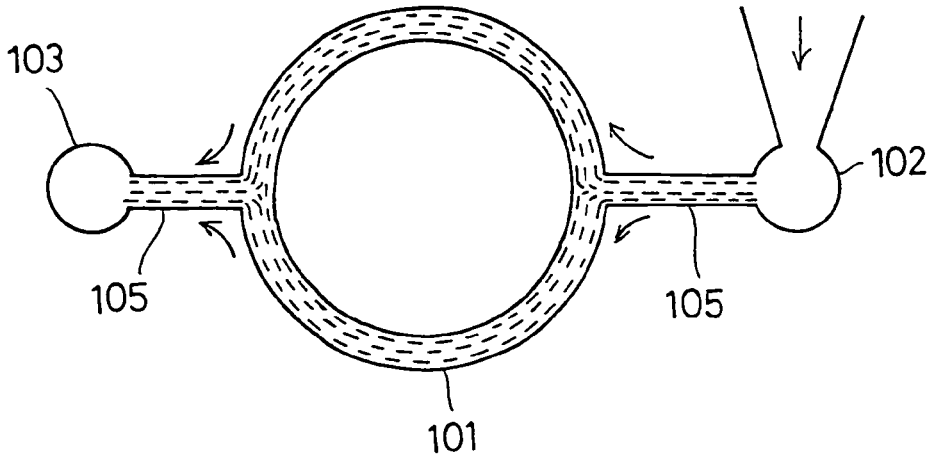
FIG. 28 is a diagrammatic top view showing a flow of resin within the mold die shown in FIG. 27.

As shown in FIGS. 27 and 28, a spool molding die 100 comprises a main body 101, an inlet port 102, an outlet port 103 and an alignment plate 105. In FIGS. 27 and 28, arrows indicate the direction of flow of the resin.

The inlet port 102, the outlet port 103 and the alignment plate 105 forming the path of the resin are formed extending in the axial direction of the main body 101 which is the molding die of the spool itself, so that the orientation of the glass fibers within the resin is uniformed across the axial length of the main body 101. A width of the path of the resin formed within the alignment plate 105 is narrow, so that the orientation of the glass fibers is liable to go along the direction of the flow of the resin.

When the resin is injected from the inlet port 102, the glass fibers which are oriented almost uniformly along the direction of flow of the resin within the alignment plate 105 are oriented uniformly along the flow of the resin within the main body 101, i.e., along the circumferential direction thereof, and flows out of the outlet port 103 via the alignment plate 105.

Because each spool is molded of the resin material containing at least one of PPE, PS and PBT and more than 5 weight % of the rubber component whose glass transition point temperature Tg is −30° or less to enhance the toughness of the spool in low temperature, the spool repeats expansion/contraction without cracking while adhering with the coil by the epoxy resin 26 infiltrating between wire rods composing each coil even if the ambient temperature changes. In particular, because the toughness of each spool may be maintained in low temperature, it is possible to prevent each spool from cracking in low temperature during which the tenacity is inclined to drop. Accordingly, it is possible to prevent electric discharge from occurring along a crack of the spool between the coil wires composing the coil. Further, it is possible to prevent electric discharge from occurring between the secondary coil 21 which is located in the vicinity of the core 12 and generates high voltage and the core 12 and to prevent dielectric breakdown from occurring between the secondary coil 21 and the core 12.

Further, because a fluidity of the resin material drops and it becomes difficult to mold the spool when the rubber component is added to enhance the toughness of the spool, the drop of the fluidity is suppressed by setting the solution viscosity of the resin material at 0.5 or less.

Still more, a thermal expansion coefficient of the spool in the radial direction is lowered and is made closer to that of the coil by aligning the orientation of the glass fibers contained in the resin material molding the spool along the circumferential direction. Because it allows the difference of the thermal expansion coefficient of the spool with that of the coil to be reduced and the spool to expand/contract conforming to the coil, the distortion of the spool during the expansion/contraction is reduced and the spool is prevented from cracking. Further, the disturbance of the orientation of the glass fibers may be suppressed at the confluent section of the injected resin by providing the outlet port 103 in the spool molding die, so that the orientation of the glass fibers may be uniformed along the circumferential direction of the spool.

Figure 29:
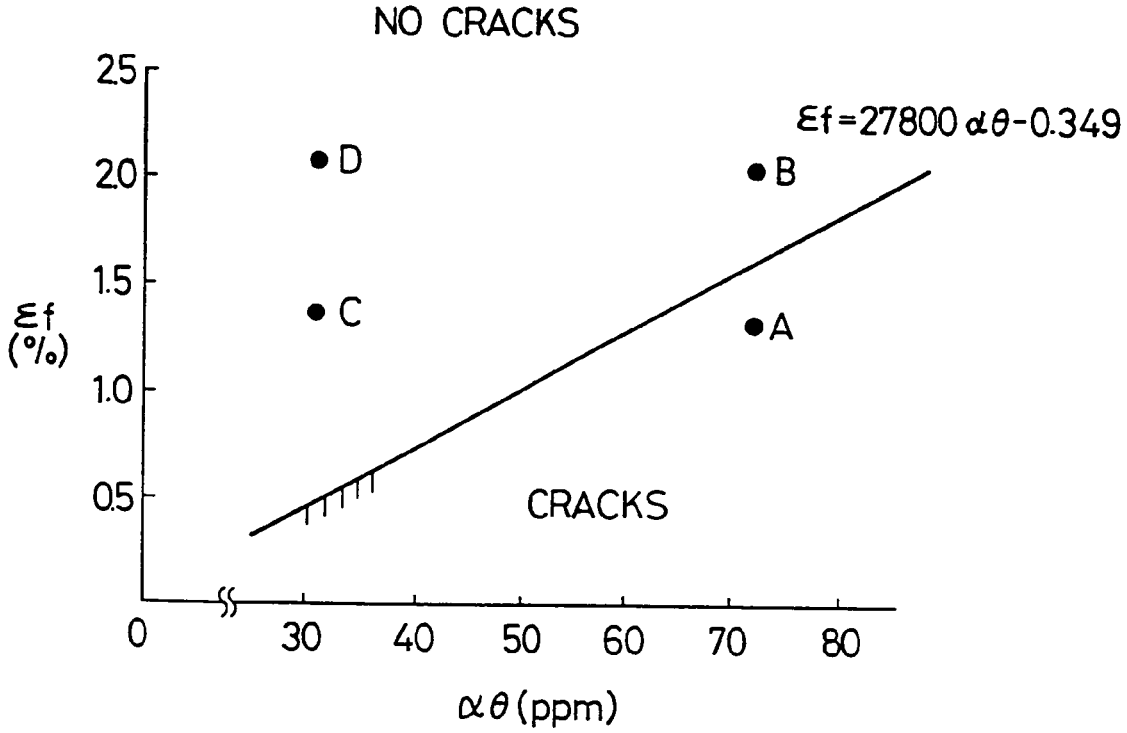
FIG. 29 is a characteristic chart showing an effect of the eleventh embodiment.

FIG. 29 is a characteristic chart showing an effect of the present embodiment. In FIG. 29, the horizontal axis represents average values $\alpha\theta$ (ppm) of the thermal expansion coefficient of the secondary spool 20 in the circumferential direction at −40° C. to 130° C. in a testing method conforming to ASTM·D696 and the vertical axis represents extensions of rupture $\epsilon f$ (%) at −40° C.

In FIG. 29, point A represents a product using a material in which 20 weight % of glass fibers GF is added to PPE and PS as the spool material. This results from a molding attained by flowing the material of the spool in the axial direction. It can be seen from this characteristic chart that the spool of this product cracks because it contains no rubber component, the extension of rupture $\epsilon f$ is small and the thermal expansion coefficient $\alpha\theta$ is large. It is noted that the boundary line which decides whether the spool cracks or not is what was found by experiments and is expressed as $\epsilon f=27800\alpha\theta-0.349$.

Point B shows characteristics of one in which 5 weight % of rubber component is added to the above product. It can be seen that the extension of rupture $\epsilon f$ increases and the spool is prevented from cracking by adding the rubber component to the prior art spool material. Point C also shows characteristics of the spool. That is, although the same spool material with that of the prior art product is used, the spool has been molded by the above-mentioned method shown in FIGS. 27 and 28. Because the glass fibers are oriented along the circumferential direction by molding the spool by the method shown in FIGS. 27 and 28, the thermal expansion coefficient $\alpha\theta$ in the circumferential direction is small ($\alpha$=30 ppm in the present embodiment), thus preventing the spool from cracking.

Point D shows characteristics of the present embodiment. That is, the thermal expansion coefficient $\alpha\theta$ in the circumferential direction is reduced and the extension of rupture $\epsilon f$ is increased by adding 5 weight % of rubber component to the above product denoted by A and by orienting the glass fibers in the circumferential direction by the method shown in FIGS. 27 and 28. It can been seen from this point that it is possible to suppress the spool from cracking by taking either one method of adding 5 weight % of rubber component or of orienting the glass fibers in the circumferential direction.

Although the glass fibers were contained in the resin material in order to prevent the plastic deformation of each spool in the embodiment, it is possible to contain glass beads or mica, instead of the glass fiber.

Twelfth Embodiment

Figure 30:
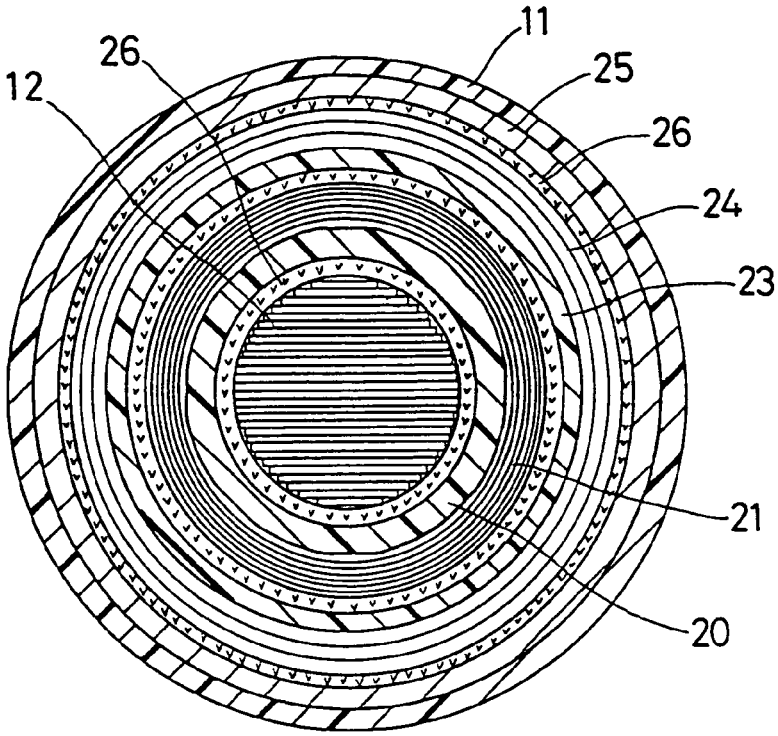
FIG. 30 is a transverse sectional view showing an ignition coil according to the twelfth embodiment of the invention.
Figure 31:
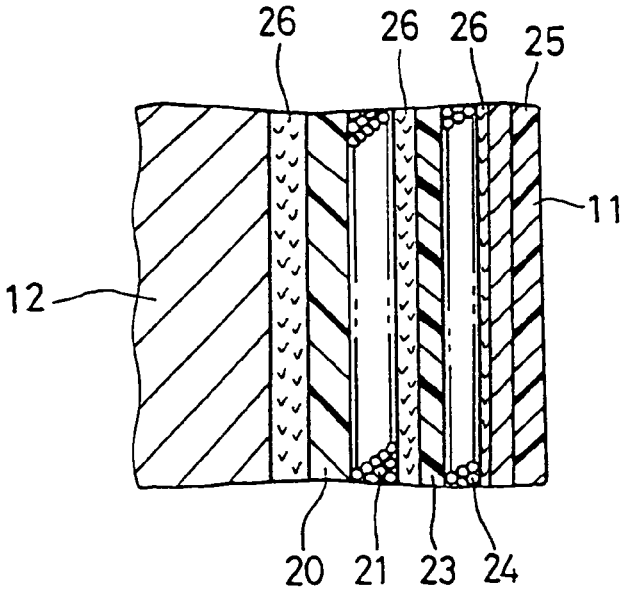
FIG. 31 is a sectional view showing a part of the twelfth embodiment shown in FIG. 30.

In the twelfth embodiment shown in FIGS. 30 and 31, the epoxy resin 26 is filled around the core 12 and no cylindrical rubber member is used. The molding material and the molding method of each spool are the same with the eleventh embodiment.

It allows the spool to be restricted from cracking with a change in temperatures in the same manner with the eleventh embodiment and the number of parts as well as the number of production steps to be reduced.

Thirteenth Embodiment

Figure 32:
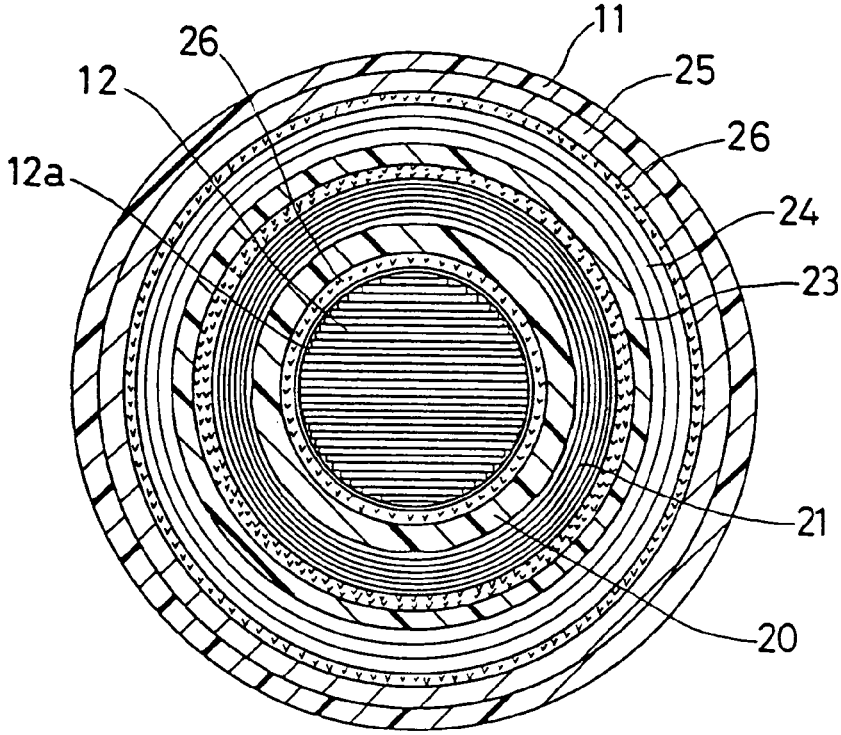
FIG. 32 is a transverse sectional view showing an ignition coil according to the thirteenth embodiment of the invention.
Figure 33:
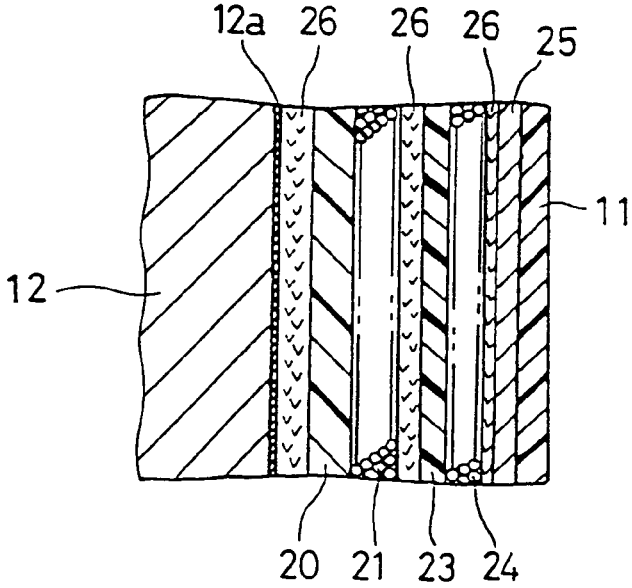
FIG. 33 is a sectional view showing a part of the thirteenth embodiment shown in FIG. 32.

In the thirteenth embodiment shown in FIGS. 32 and 33, the epoxy resin 26 is filled between the core 12 and the secondary spool 20 and a wire 12*a* is wound around the outer periphery of the core 12 across the axial direction. Thereby, the thermal expansion coefficient of the epoxy resin 26 which is greater than that of the core 12 is reduced apparently only around the outer periphery of the core 12. Accordingly, the distortion of the epoxy resin 26 caused at the face of contact with the core 12 with a change in temperatures is reduced and the epoxy resin 26 may be prevented from cracking.

Further, because a corner section at a stepped portion of the outer periphery of the core 12 having a laminated structure is covered by the wire 12*a*, it is possible to prevent the epoxy resin 26 filled between the core 12 and the secondary spool 20 on the side of core 12 from cracking.

Although the wire 12*a* has been wound around the outer periphery of the core 12, it is possible to wind a wire formed of a glass fiber around the core 12 or to cover the core 12 by a tube knitted by glass fibers. Further, it is possible to add an additive which reduces the thermal expansion coefficient of the epoxy resin 26 filled between the core 12 and the secondary spool 20 at least in the vicinity of and across all around the core 12.

Still more, although the epoxy resin 26 which is filled within the housing 11 as the resin insulator is also filled between the core 12 and the secondary spool 20, the epoxy resin 26 which is to be solidified as the resin insulator may be filled only between the core 12 and the secondary spool 20 and a fluid such as insulating oil may be used for the insulation between other members.

Although the rubber component has been included in the resin material of both the secondary spool 20 and the primary spool 23, the primary spool 20 on the outer periphery side may be molded without including the rubber component. Further, it is possible to reverse the position of the secondary spool 20 and the primary spool 23 and to dispose the secondary spool 20 on the outer periphery side and the primary spool 23 on the inner periphery side. Both of the secondary spool 20 and the primary spool 23 may be molded by including the rubber component within the resin material and the secondary spool on the outer periphery side may be molded without including the rubber component.

Still more, although the spool can be suppressed from cracking by enhancing the toughness of the spool and by reducing its thermal expansion coefficient, it is possible to suppress the spool from cracking by reducing elastic modulus of the spool in the circumferential direction. That is, it is possible to prevent the spool from cracking by absorbing the distortion by softening the spool itself and by making it extendible. For instance, it is possible to prevent the spool from cracking by adopting a material containing at least either one of silicon, flexible epoxy and elastomer having small elastic modulus as the material for molding the spool and by reducing the elastic modulus in a testing method conforming to ASTM·D790 to 1 MPa to 1000 MPa. Here, the spool becomes too soft and the windability in winding a coil around the spool drops when the elastic modulus is reduced below 1 MPa. Further, the distortion cannot be absorbed fully when it is greater than 1000 MPa.

Although the thermal expansion coefficient $\alpha\theta$ of the spool in the circumferential direction was reduced by orienting the glass fibers in the circumferential direction, it is also possible to reduce the thermal expansion coefficient $\alpha\theta$ in the circumferential direction by adopting a material containing at least either one of PPS, PET, liquid crystal polymer and epoxy as the material for molding the spool. Specifically, the thermal expansion coefficient $\alpha\theta$ in the circumferential direction in the testing method conforming to ASTM·D696 may be reduced to 10 ppm to 50 ppm. It allows the same effect with orienting the glass fibers in the circumferential direction to be obtained. At this time, the thermal expansion coefficient $\alpha\theta$ in the circumferential direction may be reduced more readily by using the method shown in FIGS. 27 and 28 in combination.

Figure 34:
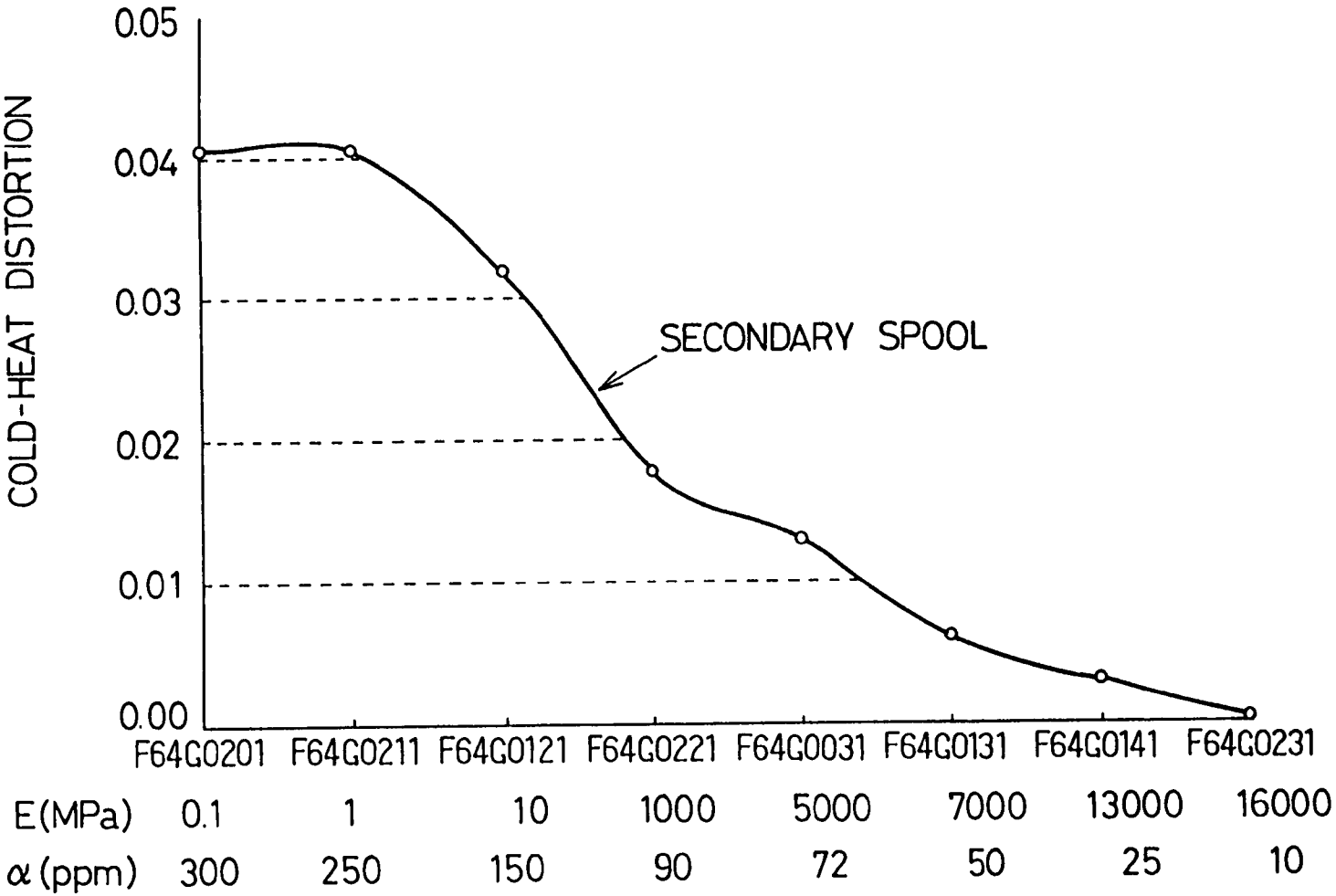
FIG. 34 is a characteristic chart showing an effect of the thirteenth embodiment.

FIG. 34 is a characteristic chart showing the effect of this time. In FIG. 34, the horizontal axis represents average values of the thermal expansion coefficient in the circumferential direction in −40° C. to 130° C. and coefficients of expansion in the testing method conforming to ASTM·D696 and the vertical axis represents thermal distortion. It can be seen also from this chart that the thermal distortion can be reduced considerably as compared with a spool having a thermal expansion coefficient (72 ppm) by reducing the thermal expansion coefficient to 10 ppm to 50 ppm.

Fourteenth Embodiment

Figure 35:
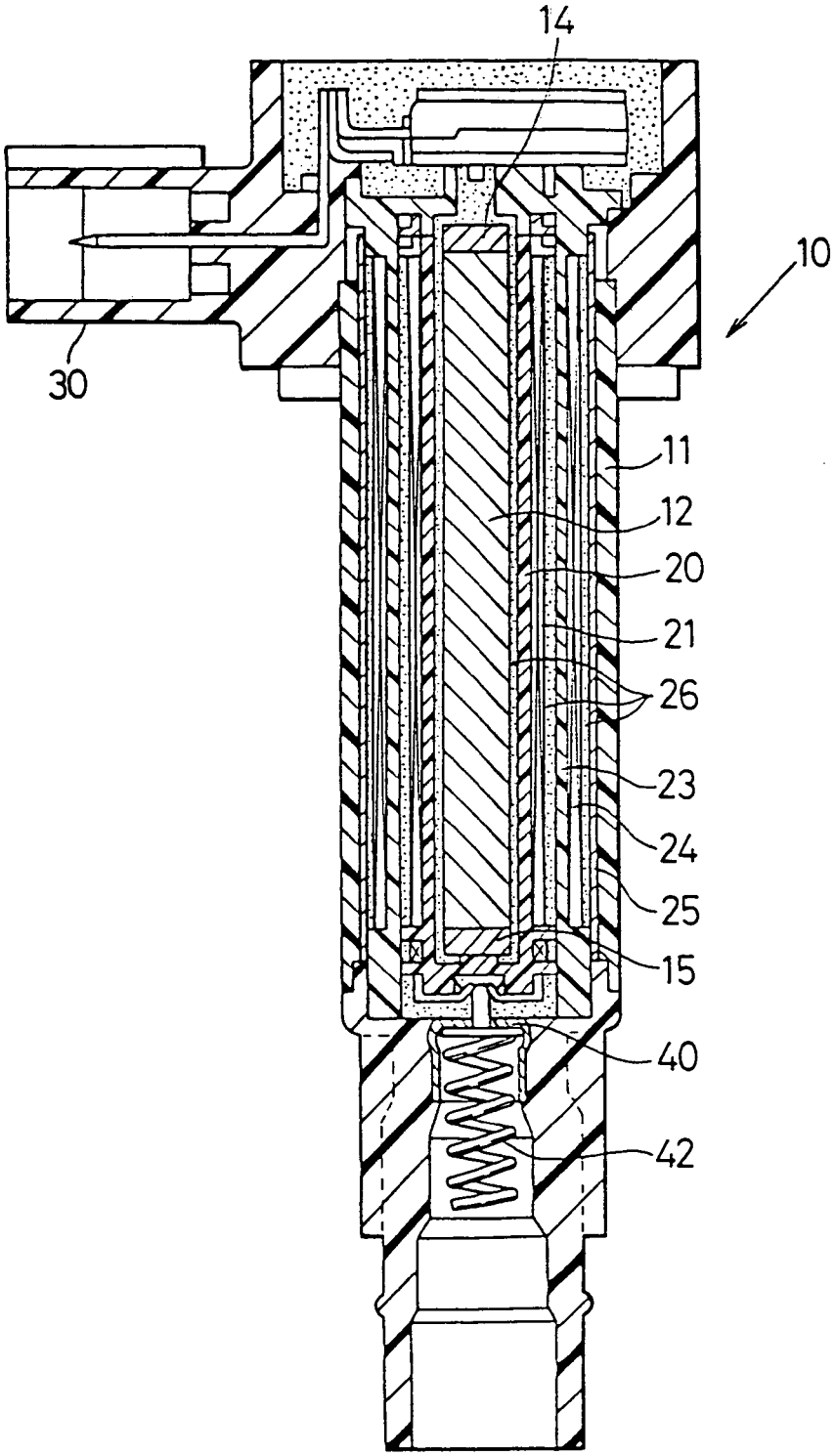
FIG. 35 is a longitudinal sectional view showing an ignition coil according to the fourteenth embodiment of the invention.

In the fourteenth embodiment shown in FIG. 35, as in the foregoing embodiments, clearances between the individual components, i.e., the central core 12, secondary spool 20, secondary coil 21, primary spool 23, primary coil 24, outer core 25 and the housing 11, are vacuum-filled with the resin insulator 26 in the ignition coil 10 to ensure electric insulations between the members and to fix the members thereby to restrict disconnections or cracks due to vibrations.

Figure 36:
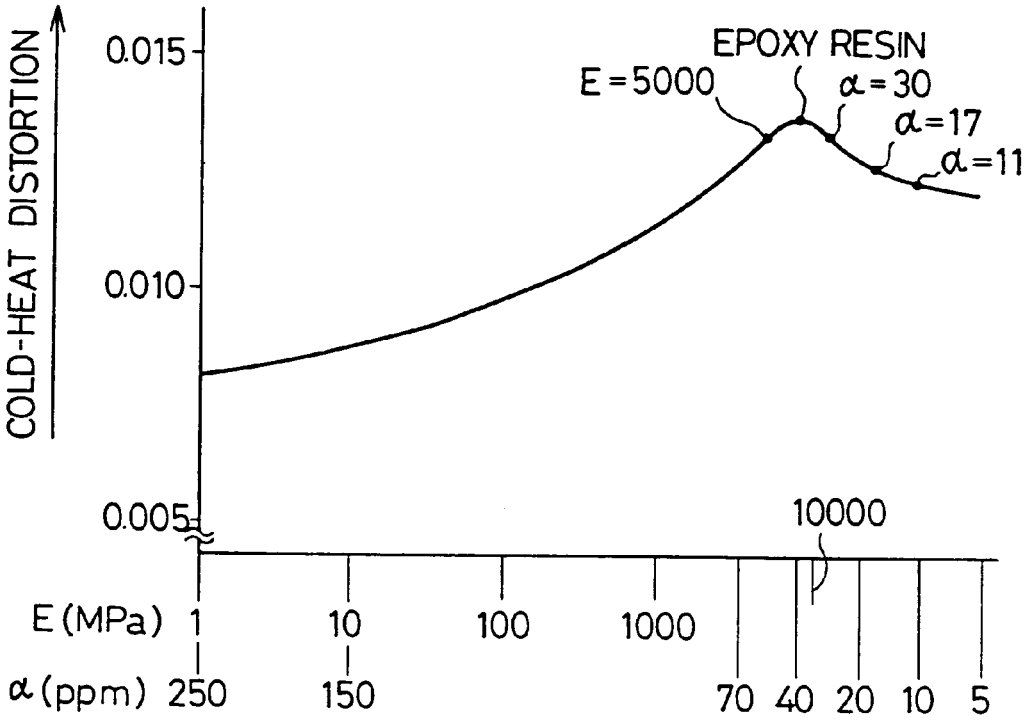
FIG. 36 is a graph showing a cold distortion of the secondary spool against the characteristic change of the insulator in the fourteenth embodiment.

The insulator 26, if made of epoxy resin, has a cold modulus of elasticity E (measured by a test method corresponding to ASTMD790) of about 8,400 MPa and a thermal expansion coefficient $\alpha$ (an average at the room temperature to 70° C. in a test method corresponding to ASTMD696) of about 40 ppm. As shown in FIG. 36, the secondary spool 20 if made of epoxy resin has the maximum heat-cold distortion. Thus, the insulator 26 if made of resin takes the maximum cold-heat distortion of the secondary spool 20. Therefore, to restrict the breakage of the individual members necessitates a separating member (e.g., film) or a buffer member (e.g., the cylindrical member of rubber).

According to various experiments conducted on the basis of the relation between the characteristics of the insulator 26 and the cold-heat distortion to occur in the secondary spool 20, it was ascertained that the breakage of the individual members in the housing 11 can be restricted by employing a flexible-insulator made of a silicone resin, urethane resin, flexible epoxy resin or the like.

Specifically, it was ascertained that the breakage of the individual members in the housing 11 can be restricted by setting the cold modulus of elasticity E of the insulator 26 no more than 5,000 MPa, and that the breakage of the members around the central core 12 can be restricted by setting the cold modulus of elasticity E of the insulator 26 no more than 10 MPa.

It was also ascertained that the cold modulus of elasticity E of the insulator 26 is preferred to be no less than 0.1 MPa because the fixing forces of the individual members drop, if the cold modulus of elasticity E of the insulator 26 is lower than 0.1 MPa, so that breakage such as disconnections or cracks may be suppressed.

On the other hand, it was also ascertained that the insulation deteriorates, as enumerated in the following Table 1, if the cold modulus of elasticity E of the insulator 26 is reduced. In case the insulation raises no serious problem, as exemplified by the ignition coil having a relatively low voltage generation or the insulator 26 capable of retaining a sufficient insulation distance, the cold modulus of elasticity E is preferred to be lower. In another case (in which the sufficient insulation has to be retained by the insulator 26), it is preferred that the cold modulus of elasticity E be no less than 10 MPa.

TABLE 1

| | Conventional | Soft | | Hard |
|---|---|---|---|---|
| | Insulator | Urethane | Silicone | Epoxy |
| E (MPa) | 8,400 | 3,000 | 2 | 15,000 |
| $\alpha$ (ppm) | 40 | 150 | 200 | 15 |
| VD (KV)*1) | 38 | 30 | 21 | 36 |
| Tg (° C.) | 110–130 | <T0 | <T0 | 110–130 |

(Insulator: Epoxy Resin, E: Cold Modulus of Elasticity at Normal Temperature, $\alpha$: Thermal Expansion Coefficient, VD: Dielectric Breakdown Voltage, Tg: Glass Transition Temperature, T0: Room Temperature)

Here in the Table 1, *1) conforms to the test method JIS·C·2105 with 40 needle electrodes buried.

It was ascertained that the cold-heat distortion of the secondary spool 20 can be reduced contrary to the foregoing experiments by reducing the thermal expansion coefficient $\alpha$ of the insulator 26 so that the breakage of the individual members in the housing 11 can be restricted without using any separation members or the like.

By setting the thermal expansion coefficient $\alpha$ of the insulator 26 within a range of 10 to 30 ppm, the breakage of the individual members in the housing 11 can be suppressed without using any separation members. By especially noting that the iron used for the central core 12 has a thermal expansion coefficient $\alpha$ of 11 ppm and that the copper used for the secondary coil 21 has a thermal expansion coefficient $\alpha$ of 17 ppm, it is ascertained that the breakage of the individual members in the housing 11 is more restricted by setting the thermal expansion coefficient $\alpha$ of the insulator 26 within a range of 11 to 17 ppm.

By setting the thermal expansion coefficient $\alpha$ of the secondary spool 20 within a range of 10 to 50 ppm, on the other hand, the thermal expansion coefficients $\alpha$ of the central core 12, the secondary spool 20 and the secondary coil 21 come close to one another to suppress occurrence of the cold-heat distortion due to the temperature change thereby to improve the durability of the ignition coil 10.

Thus, the insulator 26 is preferred to have a cold modulus of elasticity E of no more than 5,000 MPa or to have a thermal expansion coefficient $\alpha$ of no more than 30 ppm, as described above.

By using the insulator 26 having a cold modulus of elasticity E of no more than 10 MPa, on the other hand, the breakage of the members around the central core 12 can be restricted without mounting the buffer member on the central core 12 although the insulation of the insulator 26 is slightly lowered. By thus using no buffer member, the costs for preparing and assembling the buffer means can be eliminated to further suppress the cost for the ignition coil 1.

When the thermal expansion coefficient α of the insulator 26 is to be determined, its average at a temperature range of the room temperature to 70° C. was determined in the test method corresponding to ASTMD696. Thus, the average of the thermal expansion coefficient α can be easily determined because the thermal expansion coefficient α is determined in terms of the average at a temperature range from the room temperature to the glass transition temperature of 70° C.

Figure 37:
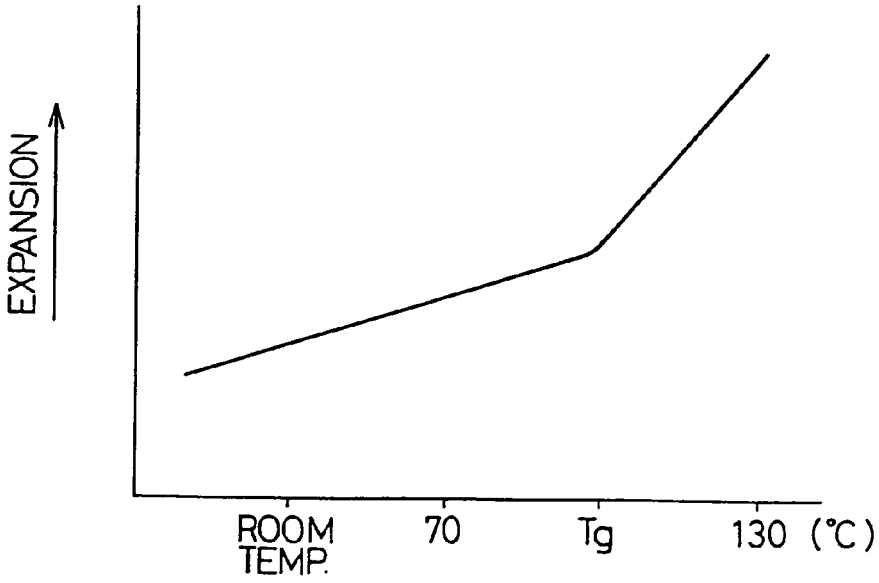
FIG. 37 is a graph showing a relation between the temperature and expansion of the insulator in the fourteenth embodiment.

That is, since the insulator 26 has a glass transition temperature Tg, as illustrated in FIG. 37, the average of the thermal expansion coefficient α is hard to determine if the glass transition temperature Tg is present in the temperature to be averaged. This glass transition temperature Tg of the insulator 26 is not present in the temperature range from the room temperature to 70° C. so that the average of the thermal expansion coefficient α can be easily determined.

Fifteenth Embodiment

Figure 38:
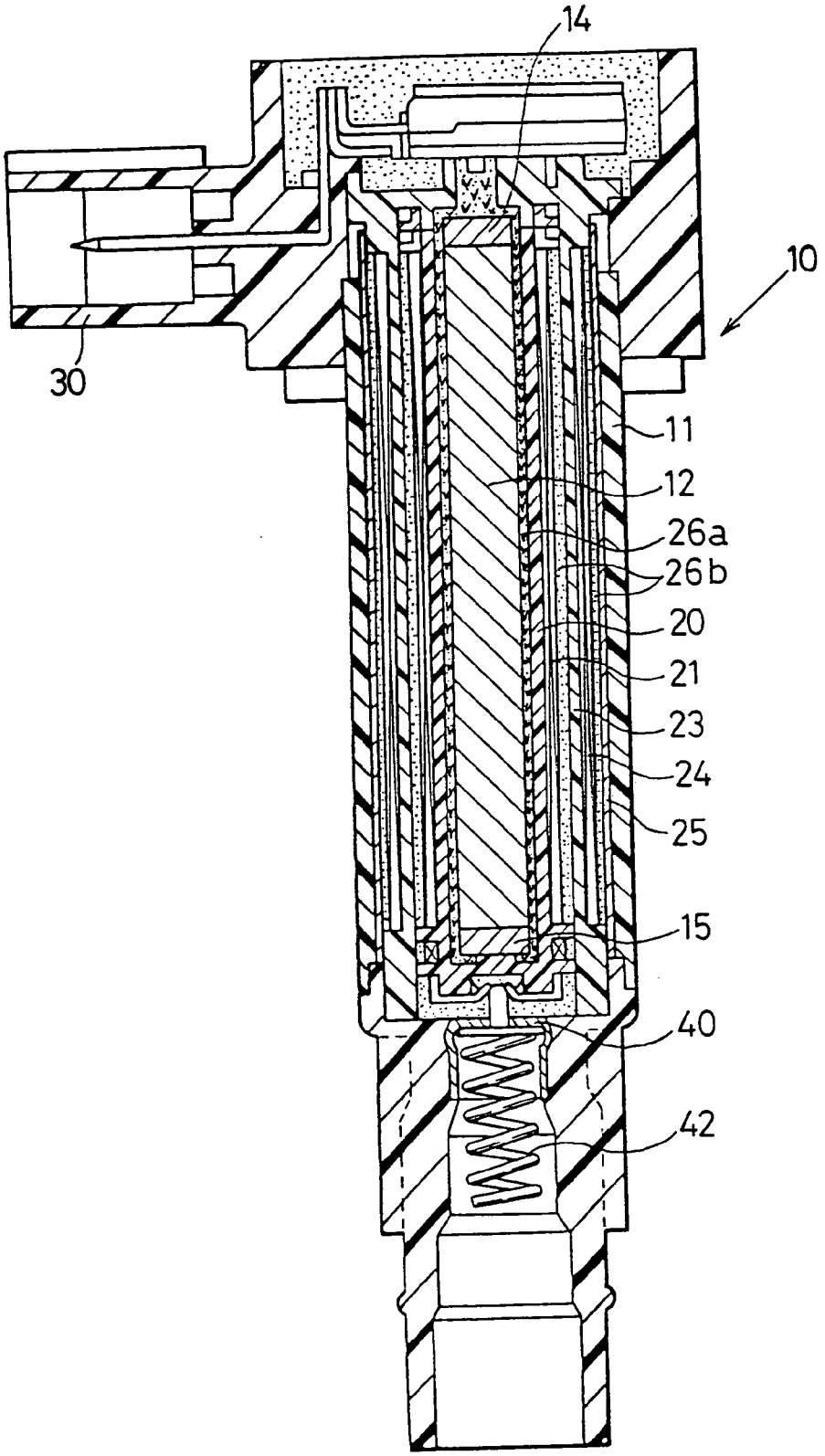
FIG. 38 is a longitudinal sectional view showing an ignition coil according to the fifteenth embodiment of the invention.

In the fifteenth embodiment shown in FIG. 38, the resin insulator is divided into inner and outer insulators 26*a* and 26*b*. The inner insulator 26*a* (e.g., a silicone resin, an urethane resin or a flexible epoxy resin) contacts directly with the central core 12 and has a cold modulus of elasticity E within a range of 0.1 to 10 MPa. The outer insulator 26*b* (e.g., a silicone resin, a urethane resin, a flexible epoxy resin, or a hard epoxy resin having no flexibility) provided radially outside of the inner insulator 26*a* has a cold modulus of elasticity E of no less than 10 MPa.

Here, the inner insulator 26*a* and the outer insulator 26*b* may be prepared either by charging the inside of the housing 11 separately with those respective materials, or by coating the outer circumference of the central core 12, as having the magnets 14 and 15 mounted thereon, in advance with the inner insulator 26*a* and assembling it in the housing 11 and subsequently by charging the inside of the housing 11 with the outer insulator 26*b*.

By thus setting the cold modulus of elasticity E of the inner insulator 26*a* no more than 10 MPa and the cold modulus of elasticity E of the outer insulator 26*b* more than 10 MPa, the breakage of the members around the central core 12 can be suppressed without mounting any buffer member such as the cylindrical member of rubber around the central core 12, and the fixing force of its outer circumference can be strengthened to restrict the breakage such as the disconnections due to the vibration. A separating member can be eliminated by setting the cold modulus of elasticity E of the outer insulator 26*b* no more than 5,000 MPa.

The fifteenth embodiments may be modified by setting the thermal expansion coefficient α of the inner insulator 26*a* within a range of 10 to 30 ppm and the thermal expansion coefficient α of the outer insulator 26*b* more than 17 ppm. By setting the thermal expansion coefficient α of the inner insulator 26*a* within a range of 11 to 17 ppm, on the other hand, the thermal expansion coefficient α of the inner insulator 26*a* can be brought close to that of the iron of the central core 12 or the copper wire of the coils 21 and 24 thereby to restrict breakages of the inside members of the ignition coil 10 due to the thermal distortion more reliably.

Although the foregoing embodiments are exemplified by mounting housing 11 on the outer circumference of the outer core 25, the housing 12 may not be used but the outer core 8 may be used to function as the housing. In this modification, the outer core 25 is sealed in its inside by baking rubber to its slit.

The present invention should not be limited to the disclosed embodiments and modifications but covers other embodiments and modifications which may be implemented by those skilled in the art.

What is claimed is:

1. An ignition coil for an engine comprising:

a central core assembly including a rod-shaped core, said central core assembly having two longitudinal ends and an edge at each said longitudinal end;

a primary spool and a secondary spool arranged around an outer circumference of the central core assembly;

a primary coil wound on the primary spool and a secondary coil wound on the secondary spool, one of the coils being disposed radially inside the other of the coils; and a first buffer member part covering said edges of said two longitudinal ends of the central core assembly, wherein the first buffer member part is formed into a tube shape and has a hole therein on at least one of the two longitudinal ends of the central core assembly; and the hole is smaller in diameter than the central core assembly.

2. The ignition coil of claim 1, further comprising:

a second buffer member part arranged on at least one of the two longitudinal ends of the central core assembly.

3. An ignition coil for an engine comprising:

a central core assembly including a rod-shaped core, said central core assembly having two longitudinal ends and an edge at each said longitudinal end;

an insulating spool arranged around the core assembly, the spool being made of a resin material having a coefficient of thermal expansion different from a coefficient of thermal expansion of the core assembly;

a coil wound on the insulating spool; and an elastic buffer member disposed between the central core assembly and the spool and covering at least one of said edges of said longitudinal ends of the central core assembly to thereby restrict a direct contact between said at least one longitudinal end corner of the central core assembly and the spool;

the elastic buffer member includes a cylindrical part and an end part integrally extending from a longitudinal end of the cylindrical part;

the cylindrical part is disposed on a cylindrical surface of the central core assembly;

the end part is disposed on a longitudinal end surface of the central core assembly; and the end part is thicker than the cylindrical part.

4. The ignition coil of claim 3, wherein the annular plate end part has a hole at a radial center thereof.

5. The ignition coil of claim 3, wherein the elastic buffer member is formed from an elastomer resin.

6. The ignition coil of claim 3, wherein the elastic buffer member is shaped in a form of a thermally-contractable tube.

7. The ignition coil of claim 3, wherein the central core assembly includes a permanent magnet attached to a longitudinal end of the core and has an end corner that is covered with the elastic buffer member.

8. The ignition coil of claim 3, wherein:

said insulating spool and said coil are provided as a secondary side for generating a high ignition voltage; and another spool with coil wound thereon are provided as a primary side radially outside said insulating spool and said coil of the secondary side.

9. An ignition coil for an engine comprising:

a central core assembly including a rod-shaped core, said central core assembly having two longitudinal ends and an edge at each said longitudinal end;

an insulating spool arranged around the core assembly, the spool being made of a resin material having a coefficient of thermal expansion different from a coefficient of thermal expansion of the core assembly;

a coil wound on the insulating spool; and an elastic buffer member disposed between the central core assembly and the spool and covering at least one of said edges of said longitudinal end of the central core assembly to thereby restrict a direct contact between said at least one longitudinal end corner of the central core assembly and the spool, wherein:

the elastic buffer member includes a cylindrical part and an annular end part integrally extending from a longitudinal end of the cylindrical part;

the cylindrical part is disposed on a cylindrical surface of the central core assembly;

the annular end part is disposed on a longitudinal end surface of the central core assembly; and wherein the annular end part has a hole at a radial center thereof.

10. The ignition coil of claim 9, wherein the elastic buffer member is formed from an elastomer resin.

11. The ignition coil of claim 9, wherein the elastic buffer member is shaped in a form of a thermally-contractable tube.

12. The ignition coil of claim 9, wherein the central core assembly includes a permanent magnet attached to a longitudinal end of the core and has an end corner that is covered with the elastic buffer member.

13. The ignition coil of claim 3, wherein the cylindrical part of the elastic buffer member covers the cylindrical surface of the central core assembly.

14. The ignition coil of claim 9, wherein the cylindrical part of the elastic buffer member covers the cylindrical surface of the central core assembly.

* * * * *